US012296234B2

(12) United States Patent
Reed et al.

(10) Patent No.: US 12,296,234 B2
(45) Date of Patent: May 13, 2025

(54) GOLF CLUB HEAD WITH STRESS-REDUCING FEATURES

(71) Applicant: Callaway Golf Company, Carlsbad, CA (US)

(72) Inventors: Nathan Reed, San Diego, CA (US); James A. Seluga, Carlsbad, CA (US); Denver Holt, Carlsbad, CA (US); David Handy, Carlsbad, CA (US)

(73) Assignee: Topgolf Callaway Brands Corp., Carlsbad, CA (US)

( * ) Notice: Subject to any disclaimer, the term of this patent is extended or adjusted under 35 U.S.C. 154(b) by 611 days.

(21) Appl. No.: 17/745,591

(22) Filed: May 16, 2022

(65) Prior Publication Data

US 2023/0049575 A1 Feb. 16, 2023

Related U.S. Application Data

(63) Continuation-in-part of application No. 17/540,087, filed on Dec. 1, 2021, now abandoned, which is a continuation-in-part of application No. 17/475,185, filed on Sep. 14, 2021, now abandoned.

(60) Provisional application No. 63/232,595, filed on Aug. 12, 2021.

(51) Int. Cl.
*A63B 53/04* (2015.01)

(52) U.S. Cl.
CPC ..... *A63B 53/0433* (2020.08); *A63B 53/0416* (2020.08); *A63B 53/0466* (2013.01); *A63B 2053/0491* (2013.01)

(58) Field of Classification Search
CPC ..... A63B 53/0466; A63B 2053/0491; A63B 2209/00; A63B 53/04; A63B 53/045
See application file for complete search history.

(56) References Cited

U.S. PATENT DOCUMENTS 5,255,918 A * 10/1993 Anderson ..... A63B 60/00 473/330
5,346,219 A * 9/1994 Pehoski ..... A63B 53/0487 473/340
5,499,814 A * 3/1996 Lu ..... A63B 60/00 473/332
6,299,547 B1 * 10/2001 Kosmatka ..... A63B 53/0466 473/345
7,914,393 B2 * 3/2011 Hirsch ..... A63B 53/0466 473/332
8,834,294 B1 * 9/2014 Seluga ..... A63B 53/04 473/345
9,067,110 B1 * 6/2015 Seluga ..... A63B 53/04
9,180,349 B1 * 11/2015 Seluga ..... A63B 53/0466
(Continued)

*Primary Examiner* — William M Pierce
(74) *Attorney, Agent, or Firm* — Michael A. Catania

(57) ABSTRACT

A golf club head comprising a body and a hollow stiffening structure is disclosed herein. The body comprises a face section, a sole section, and a crown section, and defines a hollow interior. The hollow stiffening structure extends within the hollow interior from the crown section to the sole section to reduce stresses placed on the face section during impact with a golf ball. The hollow stiffening structure creates stiffness in a vertical, crown-sole direction of the body, while reducing stiffness in the horizontal, front-rear direction, and is filled with a weighted dampening insert that extends the entirety of the length of the stiffening structure and blocks entry into the stiffening structure.

20 Claims, 26 Drawing Sheets

(56) References Cited

U.S. PATENT DOCUMENTS

| | | | | |
|---|---|---|---|---|
| 9,308,423 | B1 * | 4/2016 | Tang | A63B 53/0466 |
| 9,486,677 | B1 * | 11/2016 | Seluga | A63B 53/0466 |
| 9,597,558 | B1 * | 3/2017 | Seluga | A63B 53/0466 |
| 9,597,561 | B1 * | 3/2017 | Seluga | A63B 60/52 |
| 9,687,702 | B1 * | 6/2017 | Seluga | A63B 53/0466 |
| 9,694,257 | B1 * | 7/2017 | Seluga | A63B 60/00 |
| 9,757,629 | B2 * | 9/2017 | Seluga | A63B 53/0466 |
| 9,776,058 | B2 * | 10/2017 | Seluga | A63B 53/04 |
| 9,814,947 | B1 * | 11/2017 | Seluga | A63B 53/0466 |
| 9,814,954 | B2 * | 11/2017 | Westrum | A63B 53/04 |
| 10,238,933 | B1 * | 3/2019 | Seluga | A63B 60/00 |
| 10,258,846 | B1 * | 4/2019 | Nunez | A63B 53/0466 |
| 10,369,435 | B1 * | 8/2019 | Myers | F16G 11/12 |
| 10,661,136 | B2 * | 5/2020 | Onuki | A63B 60/50 |
| 2016/0166893 | A1 * | 6/2016 | Akiyama | A63B 53/04 473/335 |
| 2019/0232129 | A1 * | 8/2019 | Nunez | A63B 53/0408 |

* cited by examiner

GOLF CLUB HEAD WITH STRESS-REDUCING FEATURES

CROSS REFERENCES TO RELATED APPLICATIONS

The present application is a continuation-in-part of U.S. patent application Ser. No. 17/540,087, filed on Dec. 1, 2021, which is a continuation-in-part of U.S. patent application Ser. No. 17/475,185, filed on Sep. 14, 2021, which claims priority to U.S. Provisional Patent Application No. 63/232,595, filed on Aug. 12, 2021, the disclosure of each of which is hereby incorporated by reference in its entirety herein.

STATEMENT REGARDING FEDERALLY SPONSORED RESEARCH OR DEVELOPMENT

Not Applicable

BACKGROUND OF THE INVENTION

Field of the Invention

The present invention relates to a golf club head with a hollow internal stiffening structure connecting a crown portion with a sole portion and disposed proximate a striking face section and a weight disposed within the hollow internal stiffening structure that improves the mass properties of the golf club head and dampens sound.

Description of the Related Art

The prior art discloses various golf club heads having interior structures. For example, Yabu, U.S. Pat. No. 6,852,038 for a Golf Club Head And Method Of Making The Same, discloses a golf club head with a sound bar, Galloway, U.S. Pat. No. 7,118,493 for a Multiple Material Golf Club Head discloses a golf club head with a composite aft body having an interior sound component extending upward from a sole section of a metal face component, Seluga et al., U.S. Pat. No. 8,834,294 for a Golf Club Head With Center Of Gravity Adjustability discloses a golf club head with a tube having a mass for adjusting the CG of a golf club head, and Dawson et al., U.S. Pat. No. 8,900,070 for a Weighted Golf Club Head discloses a golf club head with an interior weight lip extending from the sole towards the face. Many of these prior art constructions include thickened sole features to add stiffness to the body in a front-to-back, horizontal direction, which can reduce ball speed and other performance metrics when a ball is hit at the edges of the face, most notably low and high center shots.

Geometric features that remove metal material from the sole of the golf club can increase ball speed for shots hit on the low center of the face. However, the additional movement of the club body during impact with a golf ball that is created by these features is undesirable, as these features can increase deformation of the body in the vertical direction, causing the body to move in the vertical direction during impact with a golf ball, which is also referred to as the body "wrapping around itself." This deformation negatively affects club performance, and can increase the characteristic time (CT) of the golf club head and increase stress on the face.

To improve shot performance on the perimeter of the face, a new geometry is needed to reduce the body stiffness in the horizontal direction, while still actively stiffening the club in the vertical, crown-sole direction.

BRIEF SUMMARY OF THE INVENTION

The golf club head comprises a hollow stiffening structure connecting a crown section to a sole section to reduce the stress in a striking face section, increase the stiffness of the body in a vertical direction, and reduce the body stiffness in a horizontal back to front direction, during impact with a golf ball. The golf club head may be a driver, fairway wood, hybrid, iron, wedge, or putter. A weight may be disposed within the stiffening structure to adjust the mass properties of the golf club head, and the weight may be a multi-material composition including a lattice structure.

One aspect of the present invention is a golf club head comprising a body comprising a face section, a sole section extending from a lower edge of the face section and comprising a first elongated lower opening, a crown section extending from an upper edge of the face section and comprising a first elongated upper opening, a hosel, a heel end, a toe end, a hollow interior, and an aft end, a hollow stiffening structure extending from the sole section to the crown section within the hollow interior, the hollow stiffening structure comprising at least one interior wall that is suspended within the hollow interior of the body, and a weight comprising a base comprising a first material, a top rail comprising a second material, and a lattice midsection comprising a third material, wherein an upper end of the hollow stiffening structure is disposed within the first elongated upper opening and comprises a second elongated upper opening in communication with an exterior of the golf club head, wherein a lower end of the hollow stiffening structure is disposed within the first elongated lower opening and comprises a second elongated lower opening in communication with the exterior of the golf club head, wherein the weight is disposed within the hollow stiffening structure so that the top rail is disposed within and substantially closes the second elongated upper opening, and the base is disposed within and substantially closes the second elongated lower opening, wherein the hollow stiffening structure does not contact any portion of the face section, and wherein the hollow stiffening structure is entirely disposed within 1.5 inches of a rear surface of the face insert measured along a vertical, front to back plane extending through a geometric center of the face section.

In some embodiments, the golf club head may further comprise a retention screw with a head portion and a threaded extension portion, one of the sole and the hollow stiffening structure may comprise a port disposed proximate the first elongated lower opening, the base may comprise a through-hole sized to receive the threaded extension portion, and fully engaging the retention screw within the port may cause the threaded extension portion to extend through the through-hole and the head portion to press against a lower end of the base and secure the weight within the hollow stiffening structure. In other embodiments, the hollow stiffening structure may have a depth of 0.030 to 1 inch. In still other embodiments, the top rail may be integrally formed with the lattice midsection, and the second material may be the same as the third material. In other embodiments, the first material may differ from the third material, and in still other embodiments, the second material may differ from the first material and the third material, and the crown section may be composed of the second material.

In other embodiments, the first material may have a density of no less than 8 g/cc, the second material may have a density of no more than 8 g/cc, and the third material may have a density of no more than 5 g/cc. In a further embodiment, the first material may be a tungsten alloy, the second material may be selected from the group consisting of titanium alloy, steel, and aluminum alloy, and the third material may comprise a polymer. In some embodiments, the weight may have a mass of 50 to 150 grams. In other embodiments, the base may have a mass of 50 to 120 grams. In a further embodiment, the lattice midsection may have a mass of no more than 20 grams.

In any embodiment, the body may be composed of a metal alloy, and in a further embodiment the hollow stiffening structure may be composed of a metal alloy or of a non-metal material selected from the group consisting of plastic and carbon composite. In a further embodiment, the hollow stiffening structure may have a mass of less than 10 grams.

In other embodiments, the top rail may be affixed to the lattice midsection with an adhesive material, and the base may be affixed to the lattice midsection with an adhesive material. In a further embodiment, the lattice midsection may have an overhang portion that extends over a front portion of the base and faces a rear surface of the face section within the hollow stiffening member. In an alternative embodiment, the base may be affixed to the lattice midsection with a tongue and groove joint. In any embodiment, the golf club head may be selected from the group consisting of a driver head, a fairway wood head, and a hybrid head.

Having briefly described the present invention, the above and further objects, features, and advantages thereof will be recognized by those skilled in the pertinent art from the following detailed description of the invention when taken in conjunction with the accompanying drawings.

DETAILED DESCRIPTION OF THE INVENTION

Figure 1:
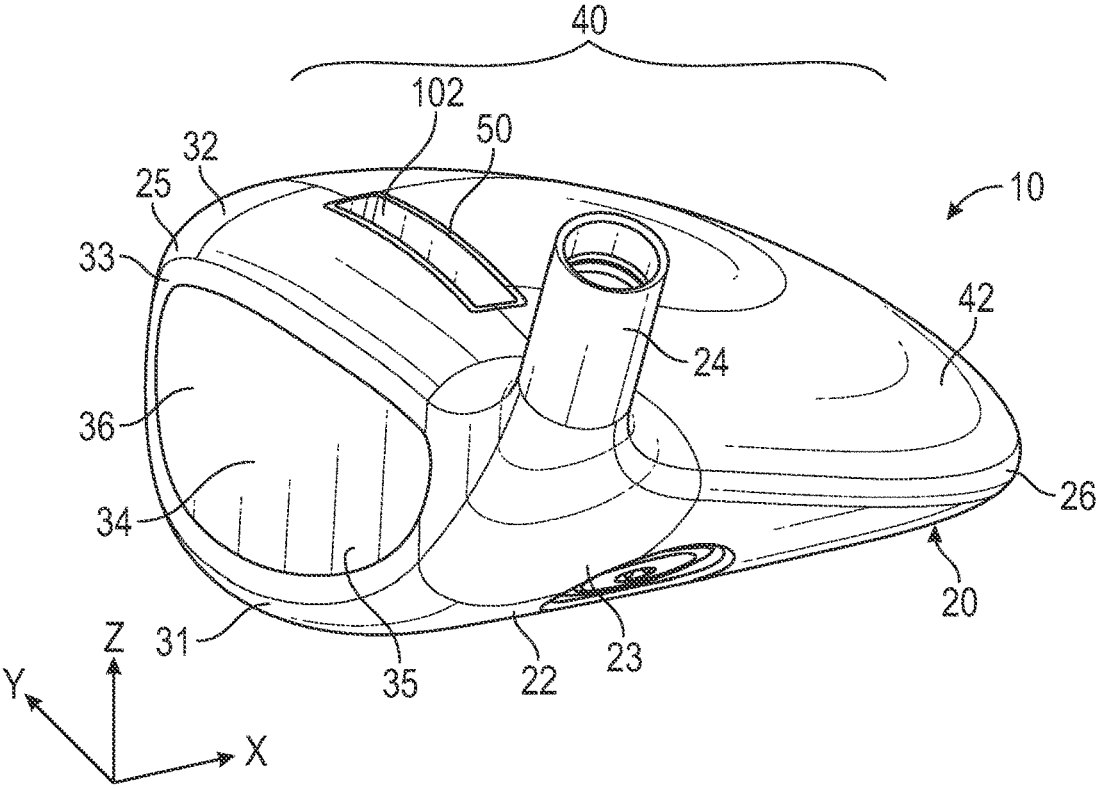
FIG. 1 is a side perspective view of a first embodiment of the golf club head of the present invention.
Figure 2:
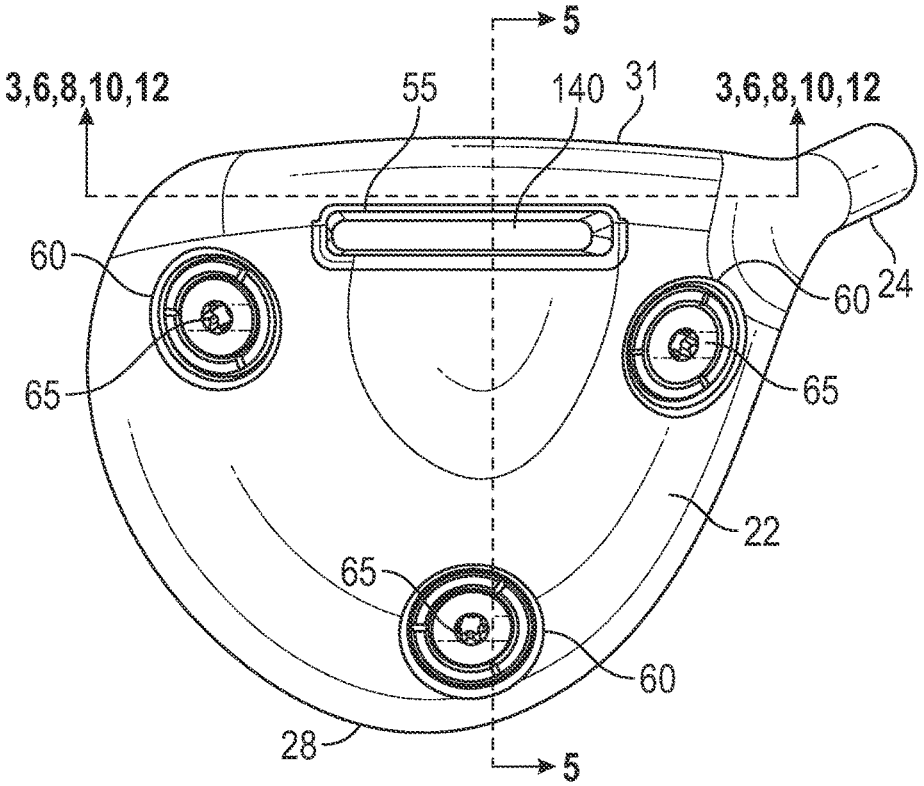
FIG. 2 is a bottom plan view of the embodiment shown in FIG. 1.
Figure 3:
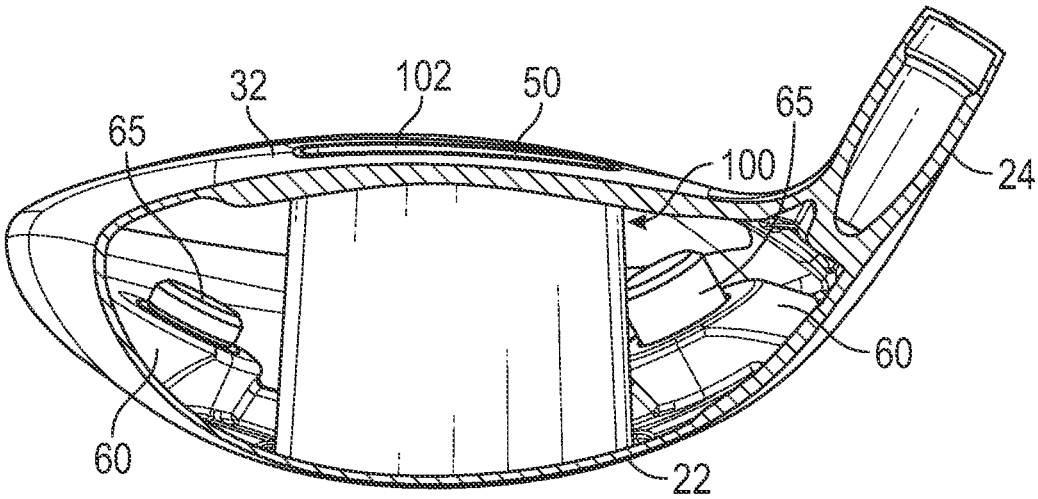
FIG. 3 is a cross-sectional view of the golf club head shown in FIG. 2 taken along lines 3-3.
Figure 4:
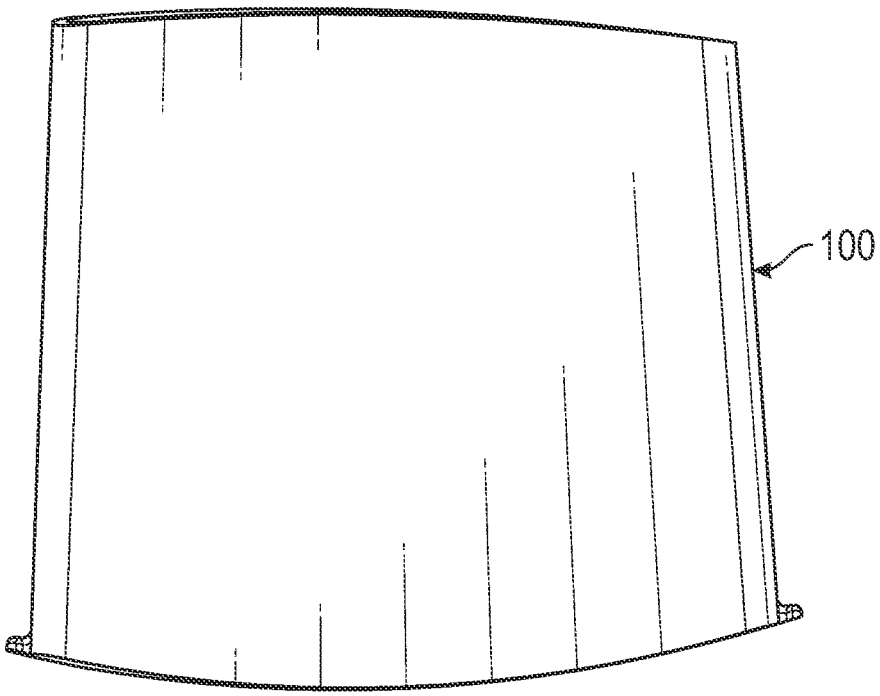
FIG. 4 is a front elevational view of the hollow stiffening structure shown in FIG. 3.

A first embodiment of the present invention is shown in FIGS. 1-5. The golf club head 10 includes a body 20 having a face section 30, a sole section 22 extending from a lower edge 31 of the face section 30, a return section 32 extending away from an upper edge 33 of the face section 30, a hosel 24 for engaging a shaft, a heel end 23, a toe end 25, an upper opening 26, a hollow interior 27, and an aft end 28. The face section 30 includes an opening 35 into which a face insert 36 is welded. A crown section 40 is comprised of the return section 32 and a crown insert 42 that is placed over the upper opening 26, and permanently affixed to the body 20, to enclose the hollow interior 27. An upper elongated opening 50 is disposed within the return section 32, extending in a heel to toe direction, and a lower elongated opening 55 is disposed within the sole section 22 beneath and aligned with the upper elongated opening 50. The sole section 22 also comprises a plurality of weight ports 60 sized to receive one or more weight screws 65.

Within the hollow interior 27, a hollow stiffening structure 100 extends from the lower elongated opening 55 in the sole section 22 upward to the upper elongated opening 50 in the return section 32. In an alternative embodiment, the hollow stiffening structure 100 may extend to the crown insert 42 instead, and in another, alternative embodiment, the body 20 may lack an upper opening 26 entirely and the crown section 40 may extend from the upper edge 33 of the striking face section all the way to the aft end 28; what is important is that, as shown in FIGS. 1-3 and 5, the hollow stiffening structure 100 connects the crown section 40 to the sole section 22 in close proximity to the rear surface 37 of the face section 30 without making contact with any portion of the face section 30, including the rear surface 37, even during impact with a golf ball. The upper and lower openings 102, 104 of the hollow stiffening structure 100, which fit within the upper and lower elongated openings 50, 55 in the body 20, are open to the exterior of the golf club head 10, and can be covered with a cap or filled with a weighted and/or elastomeric material, as further illustrated herein. There are no openings between the hollow stiffening structure 100 and the hollow interior of the body 20, which prevents any debris that might enter the hollow stiffening structure 100 from finding its way into the rest of the golf club head 10.

Figure 6:
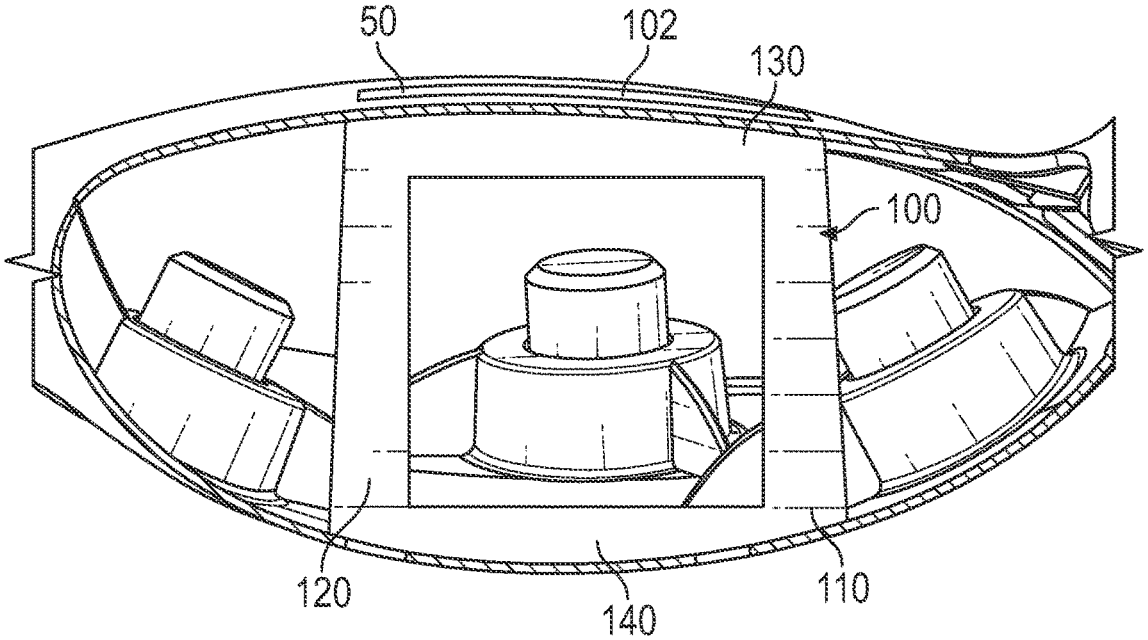
FIG. 6 is a cross-sectional view of the golf club head shown in FIG. 2 taken along lines 6-6 with a second, alternative embodiment of the stiffening structure of the present invention.
Figure 7:
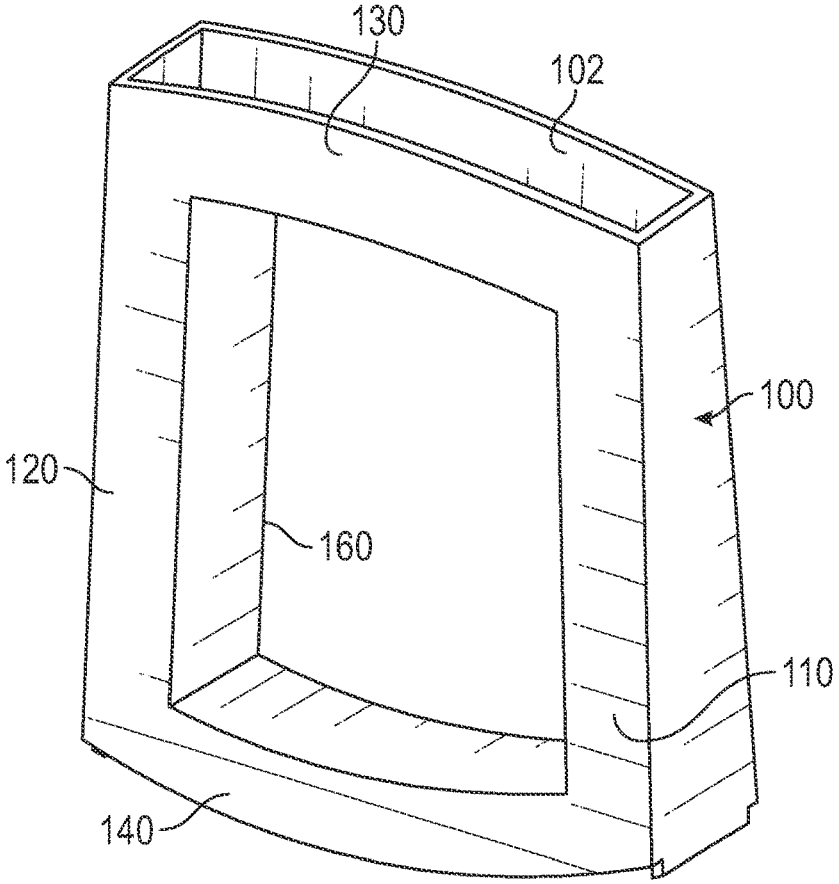
FIG. 7 is a side perspective view of the hollow stiffening structure shown in FIG. 6.

In a second embodiment of the present invention, shown in FIGS. 6-7, the golf club head 10 has the same features as the first embodiment, except that the hollow stiffening structure 100 of the present invention comprises a heel side connector 110 extending between the return section 32 and the sole section 22 proximate the heel end 23, a toe side connector 120 extending between the return section 32 and the sole section 22 proximate the toe end 25, an upper connector 130 extending between, and connecting, the heel side connector 110 and the toe side connector 120 and in communication with the upper opening 102, and a lower connector 140 extending between, and connecting, the heel side connector 110 and the toe side connector 120 and in communication with the lower opening 104. The hollow stiffening structure 100 of the second embodiment has an overall square or rectangular shape, with an opening 160 that is effectively encircled by the connectors 110, 120, 130, 140, though in alternative embodiments it may have a different geometry.

Figure 8:
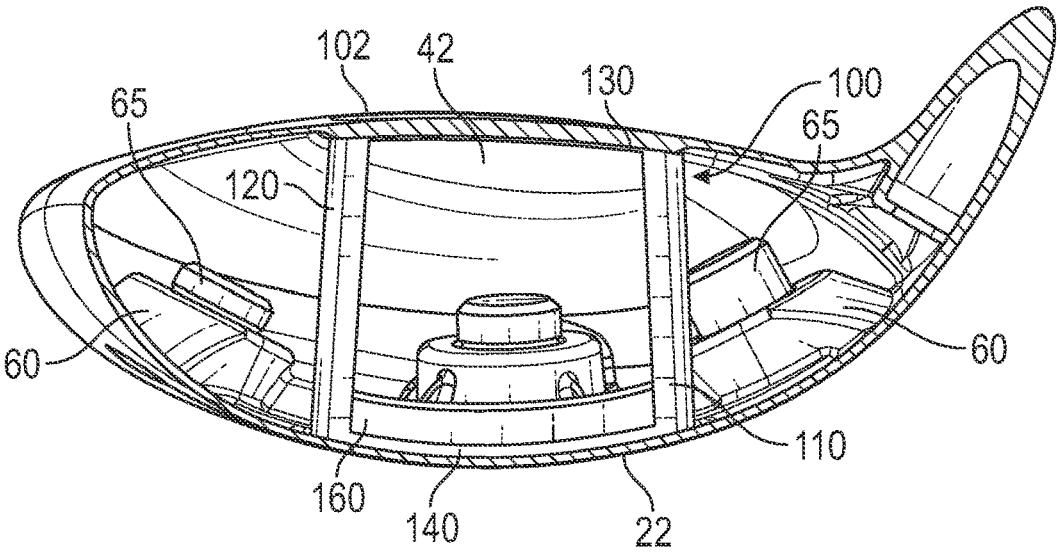
FIG. 8 is a cross-sectional view of the golf club head shown in FIG. 2 along lines 8-8 with a third, alternative embodiment of the stiffening structure of the present invention.
Figure 9:
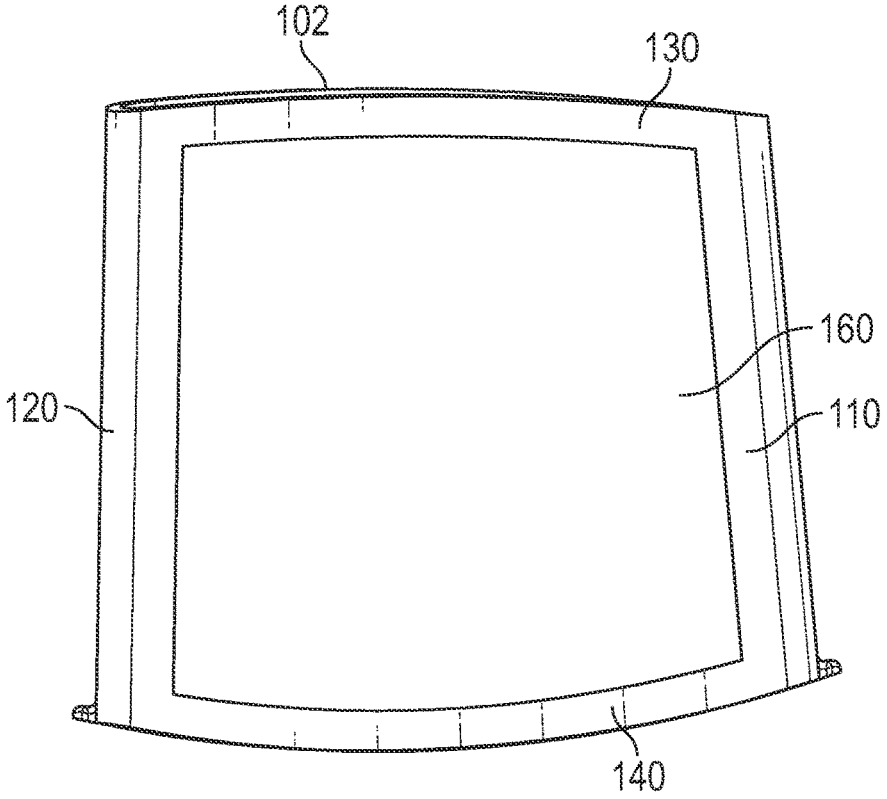
FIG. 9 is a front elevational view of the hollow stiffening structure shown in FIG. 8.

In a third embodiment, shown in FIGS. 8-9, the golf club head 10 has all of the same features as the second embodiment, except that the connectors 110, 120, 130, 140 of the hollow stiffening structure 100 are narrower and the rectangular opening 160 is larger, thereby freeing up discretionary mass and reducing the overall mass of the hollow stiffening structure 100.

Figure 10:
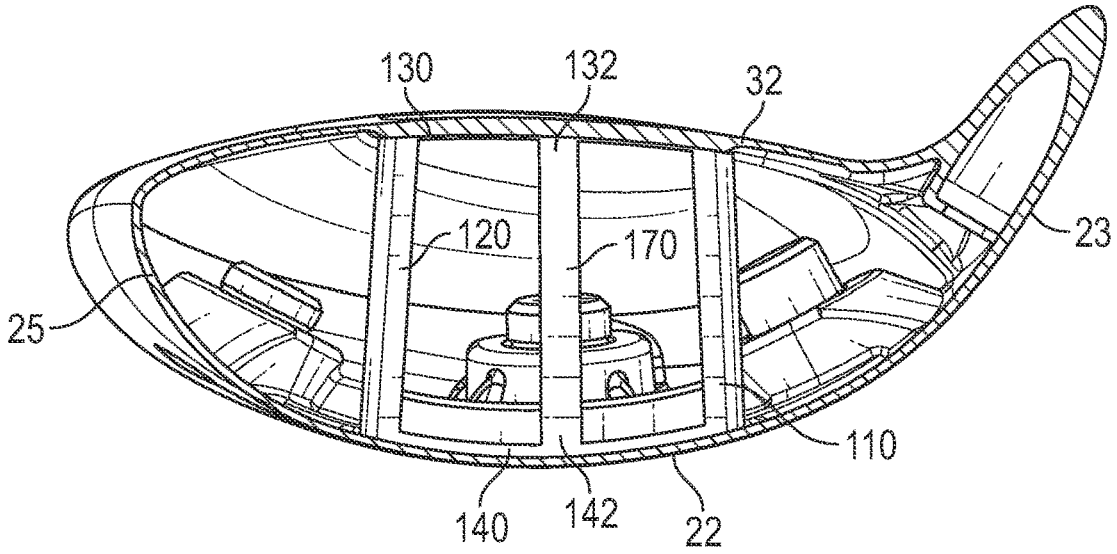
FIG. 10 is a cross-sectional view of the golf club head shown in FIG. 2 along lines 10-10 with a fourth, alternative embodiment of the stiffening structure of the present invention.
Figure 11:
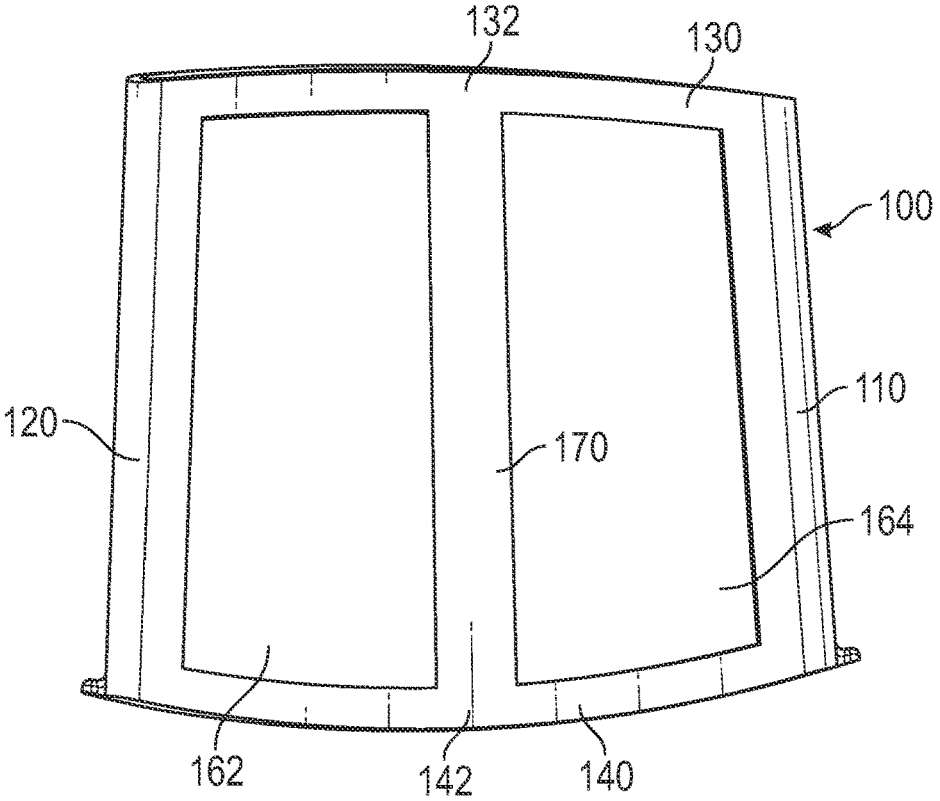
FIG. 11 is a front elevational view of the hollow stiffening structure shown in FIG. 10.
Figure 12:
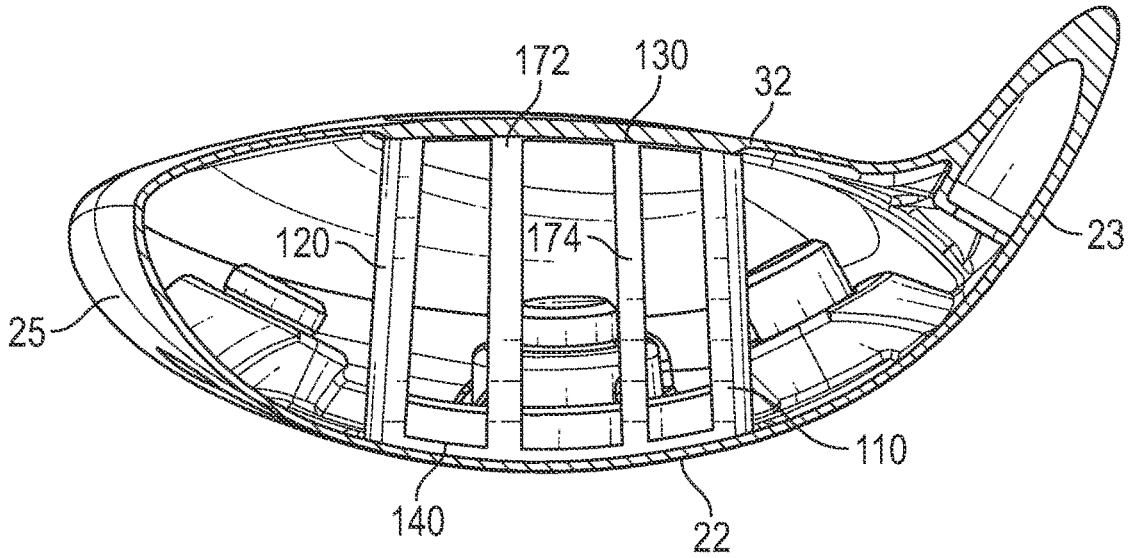
FIG. 12 is a cross-sectional view of the golf club head shown in FIG. 2 along lines 12-12 with a fifth, alternative embodiment of the stiffening structure of the present invention.
Figure 13:
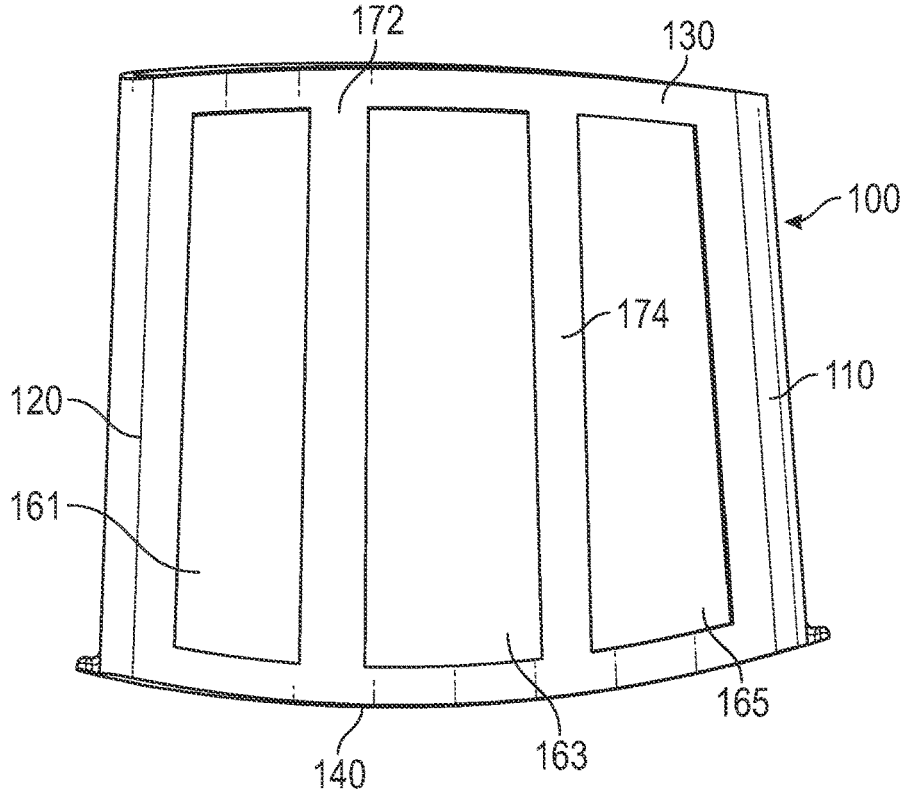
FIG. 13 is a front elevational view of the hollow stiffening structure shown in FIG. 12.

In a fourth embodiment, shown in FIGS. 10-11, the golf club head 10 has the same features as the third embodiment, except that the hollow stiffening structure 100 has a central connector 170 extending between the upper and lower connectors 130, 140 at their midpoints 132, 142, and dividing the opening 160 into two sections 162, 164. In a fifth embodiment, shown in FIGS. 12-13, the golf club head 10 has the same features as the third embodiment, except that the hollow stiffening structure 100 has two central connectors 172, 174 spaced between the heel and toe connectors to divide the opening 160 into three sections 161, 163, 165.

Figure 14:
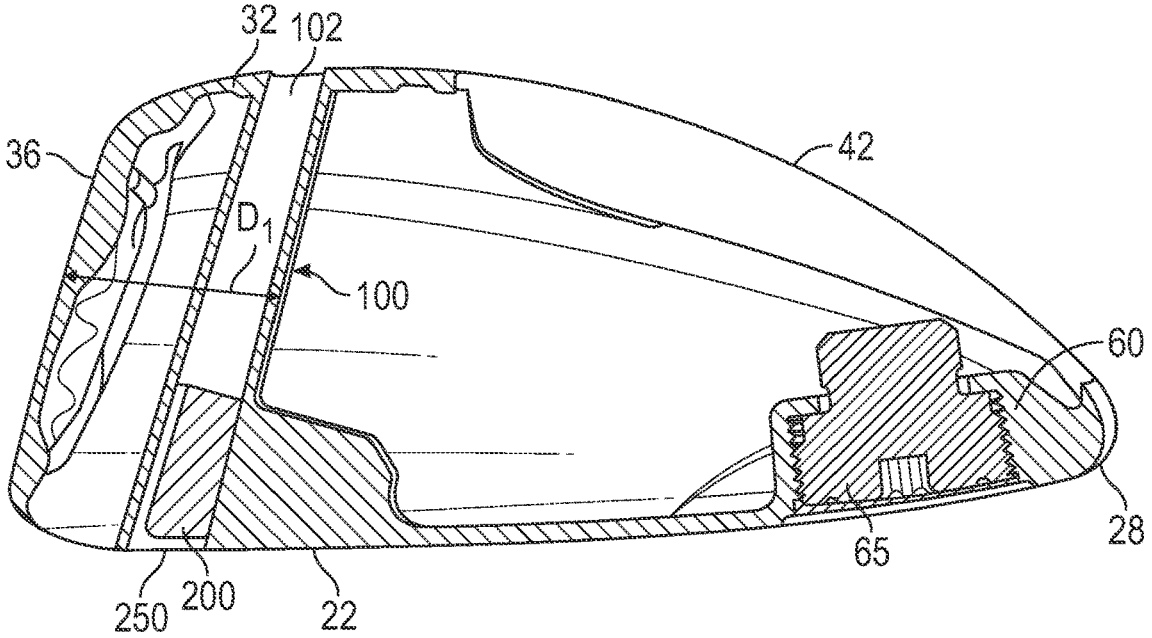
FIG. 14 is a cross-sectional view of the golf club head shown in FIG. 2 taken along lines 14-14 with a sixth, alternative embodiment of the stiffening structure of the present invention.

In a sixth embodiment, shown in FIG. 14, the golf club head 10 has all the same features as the first embodiment, with the addition of a weight 200 affixed within the lower connector 140 with a polymer adhesive 250, a portion of which is visible through the lower opening 104. In any of the embodiments disclosed herein, the weight 200 may be made of one or more dense materials, preferably tungsten, tungsten alloy, or steel. As shown in Tables I and II below, this configuration increases ball speed low on the face, reduces backspin by lowering the center of gravity (CG) height, improves spin robustness in the vertical direction utilizing higher moment of inertia Iyy and shallower CG depth, allows for customization of CG height and bias, and seals off the lower portion of the hollow stiffening structure 100 so that debris does not enter the golf club head 10 during use.

TABLE I

| Impact Frame Mass Properties (Empty Stiffening Structure 100) | | | |
|---|---|---|---|
| Cg(x), Cg(y), Cg(z) | 1.175 | −0.015 | 0.284 |
| I(xx), I(yy) I(zz) | 1876 | 1264 | 2661 |
| I(xy), I(xz), I(yz) | 133 | 103 | −69 |

TABLE II

| Impact Frame Mass Properties (Tungsten in Stiffening Structure 100) | | | |
|---|---|---|---|
| Cg(x), Cg(y), Cg(z) | 0.996 | −0.017 | 0.110 |
| I(xx), I(yy) I(zz) | 1267 | 1368 | 2005 |
| I(xy), I(xz), I(yz) | 152 | 176 | −70 |

Figure 15:
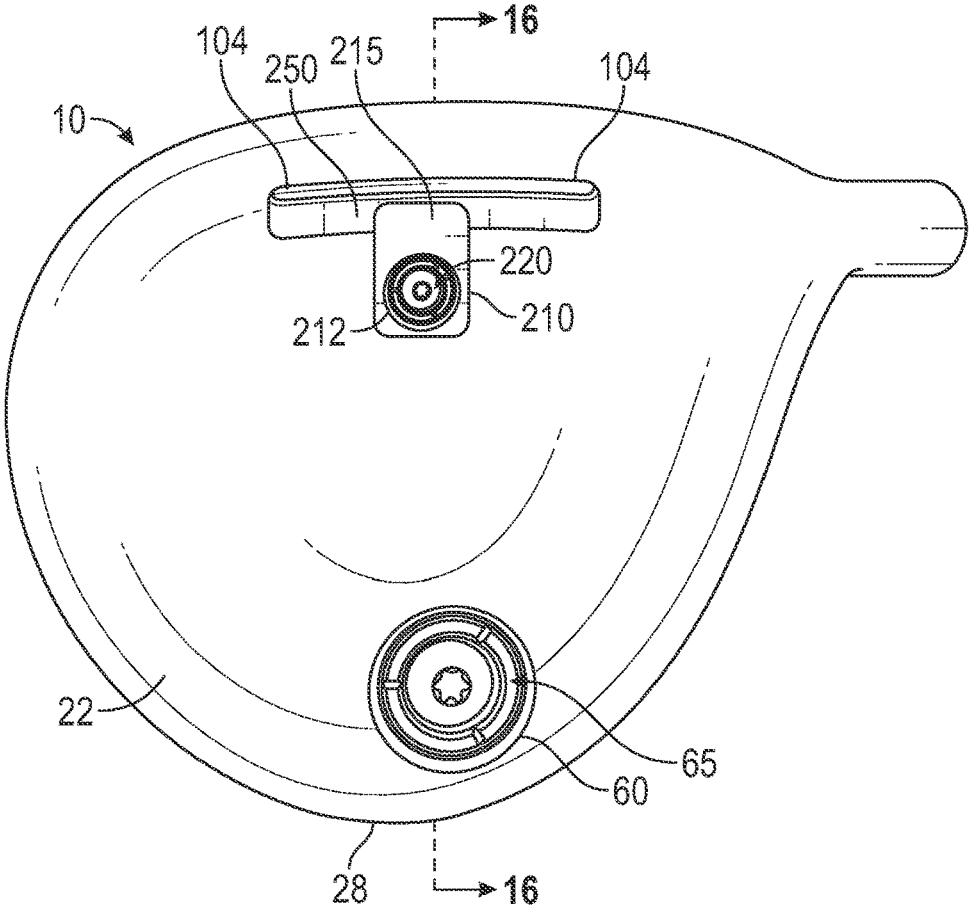
FIG. 15 is a sole plan view of a seventh embodiment of the golf club head of the present invention.
Figure 16:
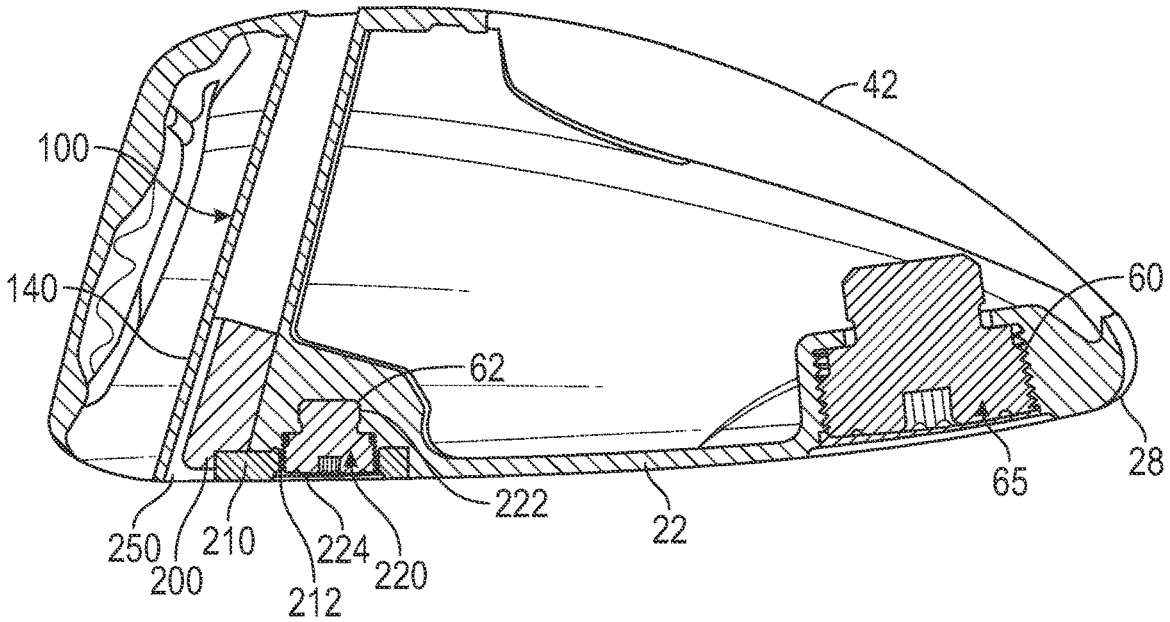
FIG. 16 is a cross-sectional view of the golf club head shown in FIG. 15 taken along lines 16-16.

In a seventh embodiment, shown in FIGS. 15 and 16, the golf club head 10 has all the same features as the sixth embodiment, except that the weight 200 is further secured within the lower connector 140 mechanically with a washer 210 and a retention screw 220. The washer 210 is elongated so that, when it is properly engaged with the sole 22, an end portion 215 of the washer 210 extends over the lower opening 104 and has a through-opening 212 sized to receive the threaded extension portion 222, but not the head 224, of the screw 220. The threaded extension portion 222 is inserted through the through-opening 212 and is screwed into a port 62 disposed proximate the lower opening 104 in the sole 22.

Figure 17:
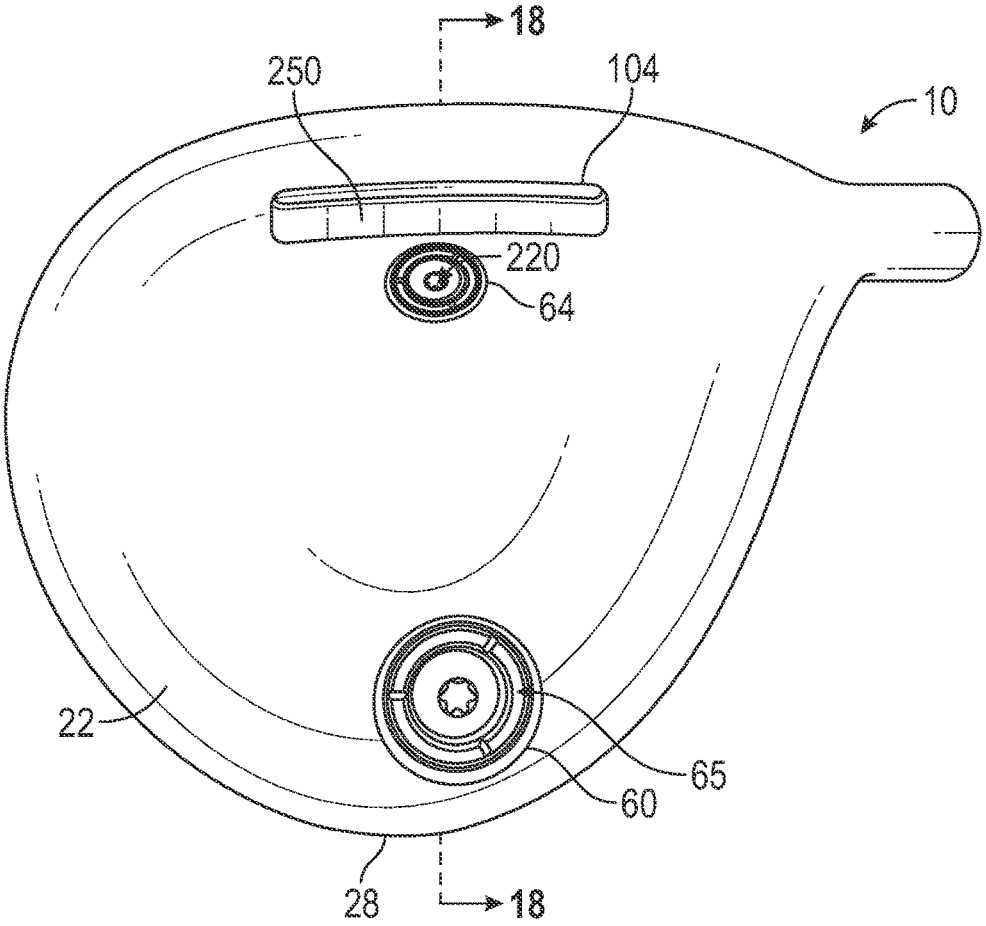
FIG. 17 is a sole plan view of an eighth embodiment of the golf club head of the present invention.
Figure 18:
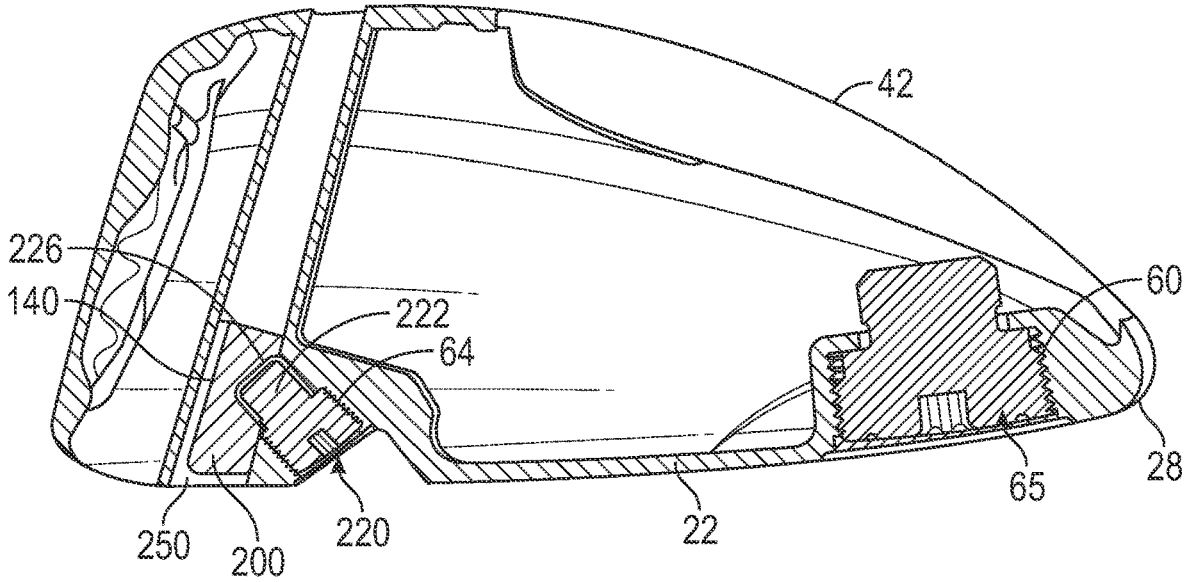
FIG. 18 is a cross-sectional view of the golf club head shown in FIG. 17 taken along lines 18-18.

In an eighth embodiment, shown in FIGS. 17 and 18, the golf club head 10 has all the same features as the sixth embodiment, except that the weight 200 is further secured within the lower connector 140 mechanically with a retention screw 220 that is inserted into an angled port 64 disposed proximate the lower opening 104 in the sole 22. The port 64 preferably communicates with and extends into an opening 230 in the lower connector 140 so that the threaded extension portion 222 of the retention screw 220 can extend into the lower connector 140. The weight 220 includes an indentation 226 sized to receive a portion of the threaded extension portion 222, which when fully engaged with the port 64 places pressure on the weight 220 within the lower connector 140.

Figure 19:
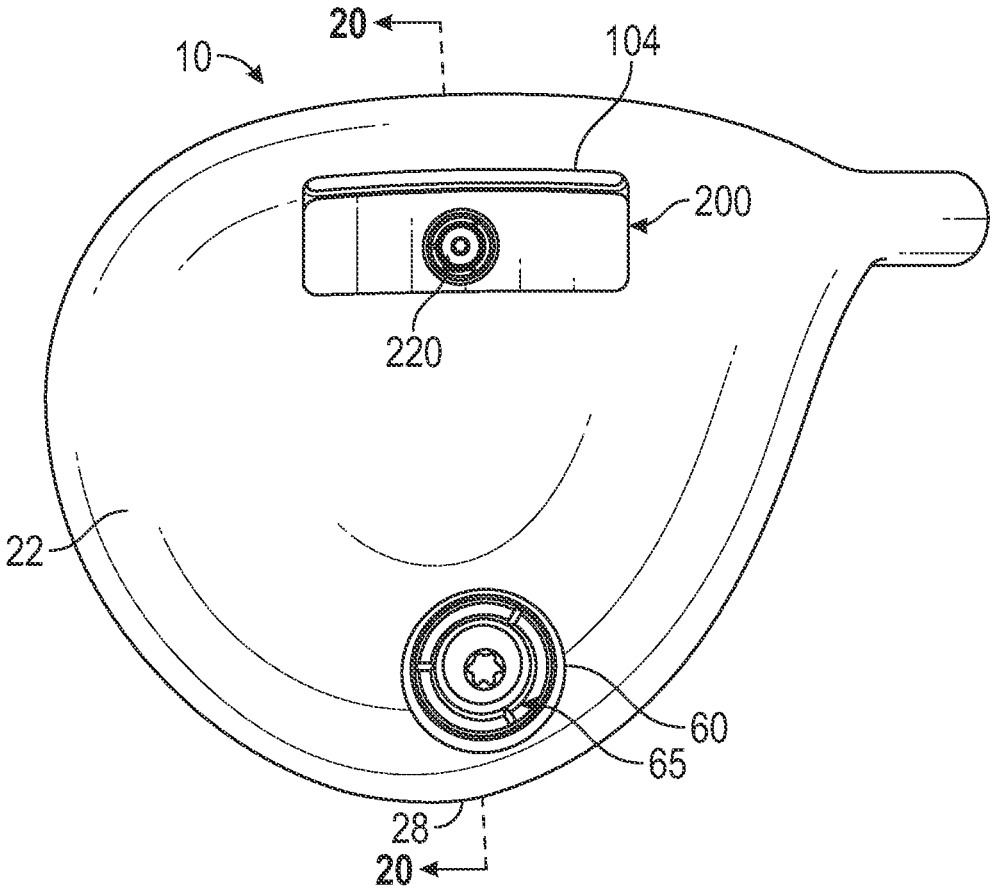
FIG. 19 is a sole plan view of a ninth embodiment of the golf club head of the present invention.
Figure 20:
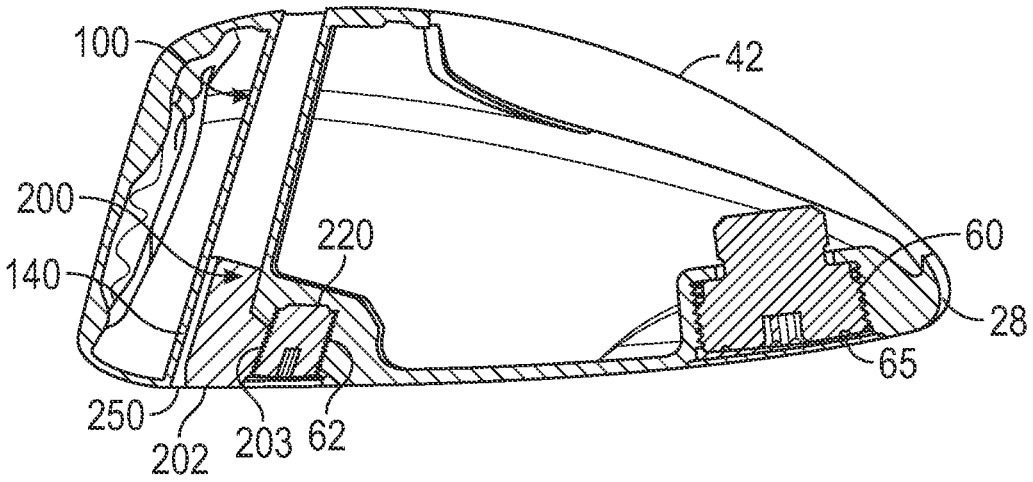
FIG. 20 is a cross-sectional view of the golf club head shown in FIG. 19 taken along lines 20-20.

In a ninth embodiment, shown in FIGS. 19 and 20, the golf club head 10 has all the same features as the eighth embodiment, except that the port 62 extends approximately parallel with the structure 100 and the weight 200 has a flared lower end 202 with an opening 203 through which the screw 220 can extend into the port 62. This configuration allows the weight 200 to be press fit into the lower connector 140 to more securely affix it to the golf club head 10.

Figure 21:
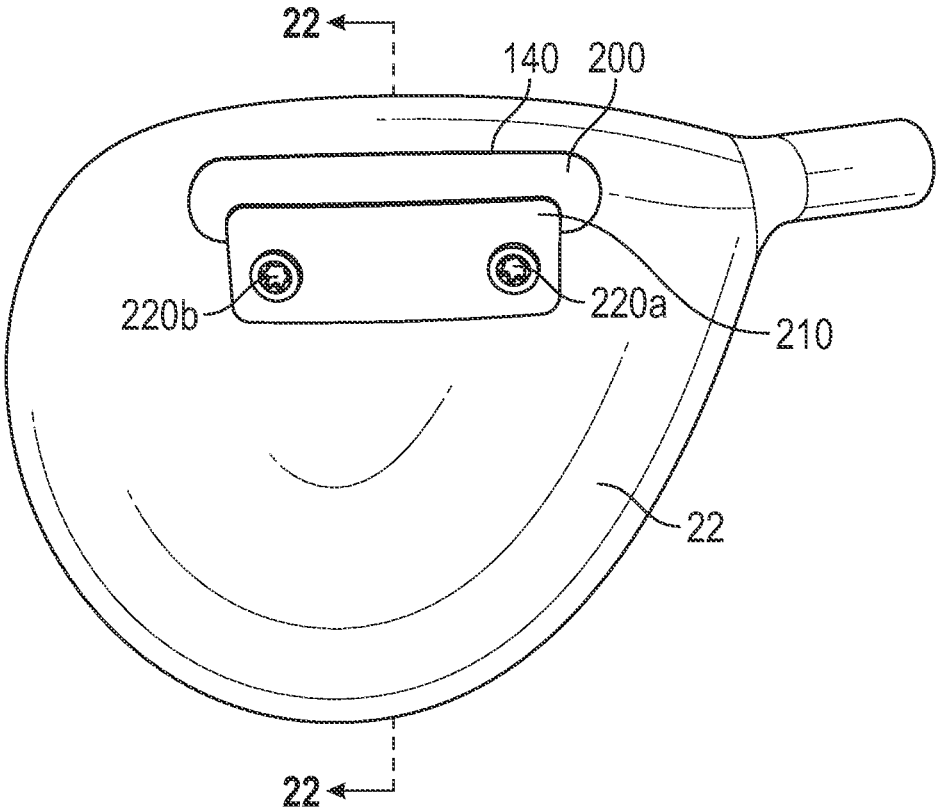
FIG. 21 is a sole plan view of a tenth embodiment of the golf club head of the present invention.
Figure 22:
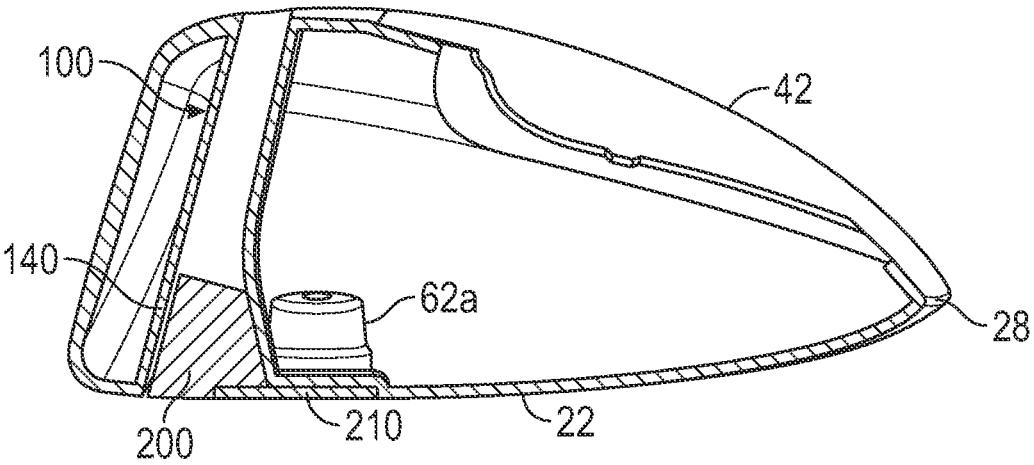
FIG. 22 is a cross-sectional view of the golf club head shown in FIG. 19 taken along lines 22-22.

A similar construction is found in the tenth embodiment shown in FIGS. 21 and 22, which includes a flared weight 200 that is press fit into the lower connector 140 and is retained within the structure 100 with a plate-like washer 210 that extends along more than two thirds of the length of the lower opening 104 to trap the weight 200 within the structure 100. In this embodiment, the washer 210 is affixed to the sole 22 with a pair of screws 220*a*, 220*b* that extend through holes in the washer 210 to engage with a pair of ports 62*a*, 62*b*.

Figure 23:
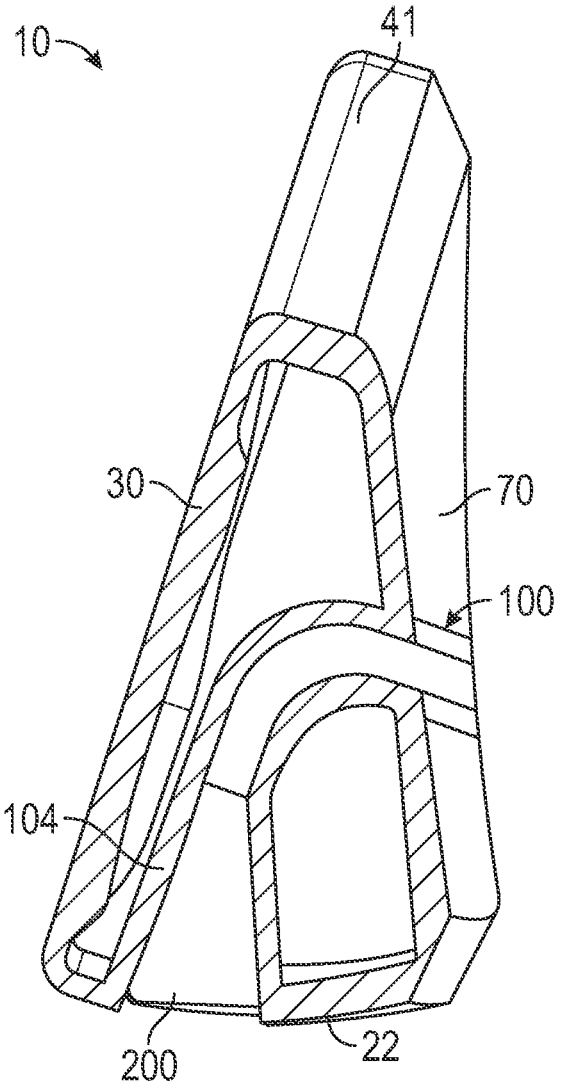
FIGS. 23 and 24 are cross-sectional and sole plan views, respectively, of an eleventh embodiment of the golf club head of the present invention.
Figure 24:
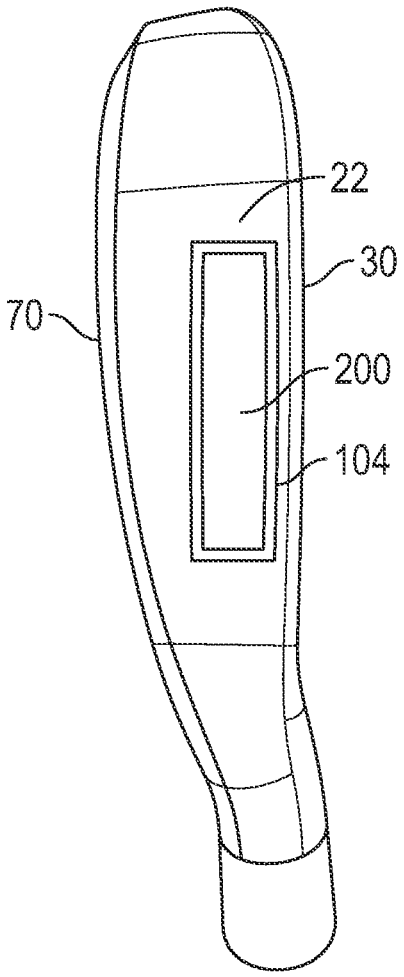
Figure 25:
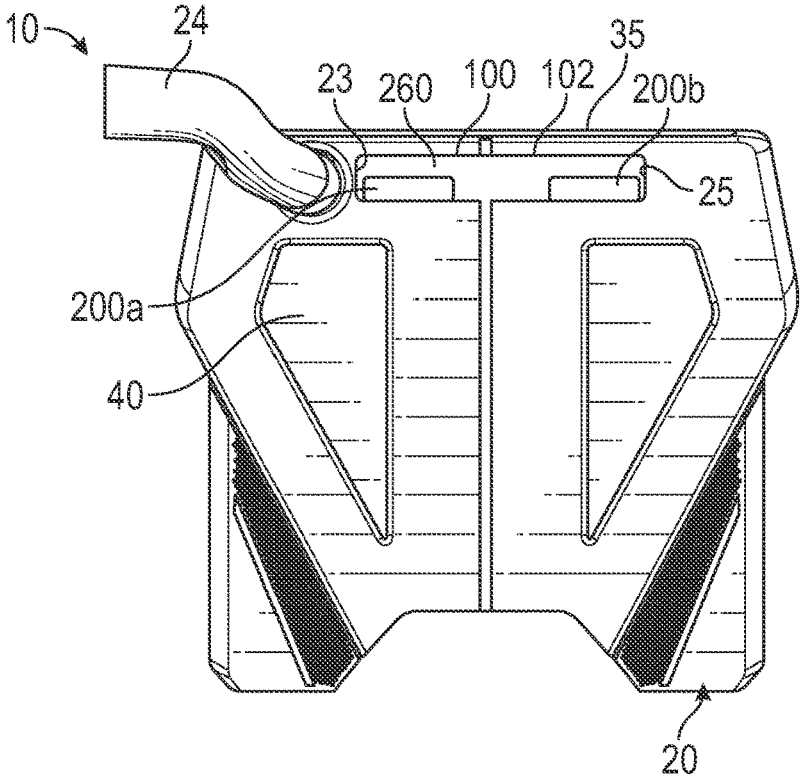
FIG. 25 is a top plan view of a twelfth embodiment of the present invention.

In an eleventh embodiment, shown in FIGS. 23 and 24, the hollow stiffening structure 100 is engaged with an iron-type golf club head, and extends from the sole 22 to a rear portion 70 instead of a topline 41. In this embodiment, the weight 200 is flared and is press fit within the lower connector 140 of the structure 100. It may be further secured within the structure 100 with an adhesive or any of the other means disclosed in connection with the other embodiments disclosed herein.

Figure 26:
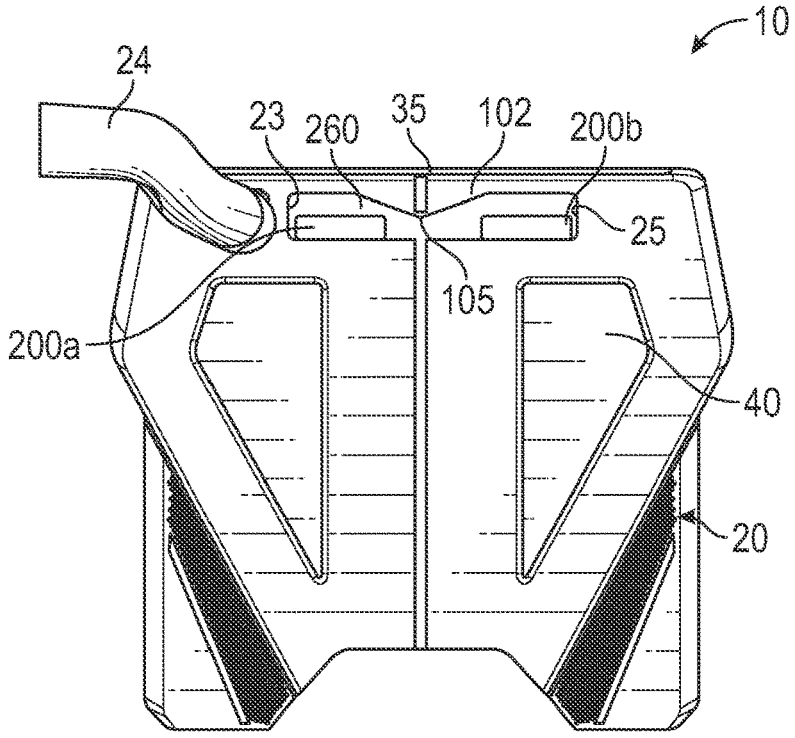
FIG. 26 is a top plan view of a thirteenth embodiment of the present invention.

In twelfth through fifteenth embodiments, illustrated in FIGS. 25-28, the hollow stiffening structure 100 and weight 200 combination is included in a putter head 10 with a variable thickness face insert 35. These features help to reduce the standard deviation of ball speed across the face insert 35 by increasing ball speed for off center hit locations and those close to the face insert 35 edges. The embodiment shown in FIG. 25 has a single stiffening structure 100 extending between the sole (not shown) and the crown 40, and two weights 200*a*, 200*b* disposed on heel 23 and toe 25 sides of the stiffening structure 100. The weights 200*a*, 200*b* are retained within the structure 100 with a polymer fill 260, which is preferably polyurethane or polyurea (or a combination thereof), which fills the remaining area within the structure 100 and embeds the weights 200*a*, 200*b* therein. A similar construction is shown in FIG. 26, which differs only in that the hollow stiffening structure 100 comprises a notch 105 at an approximately horizontal midpoint of the structure 100 and the body 20, which is designed to fill the notch to prevent the structure 100 from disengaging from the body 20. The notch 105 serves to further minimize the standard deviation of ballspeed across the face insert 35.

Figure 27:
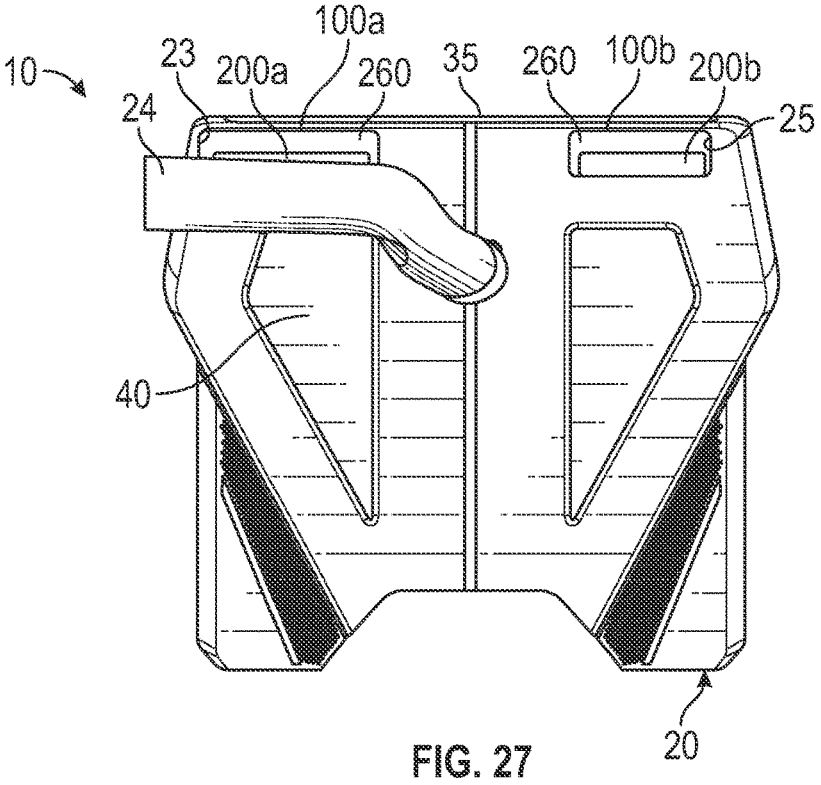
FIG. 27 is a top plan view of a fourteenth embodiment of the present invention.
Figure 28:
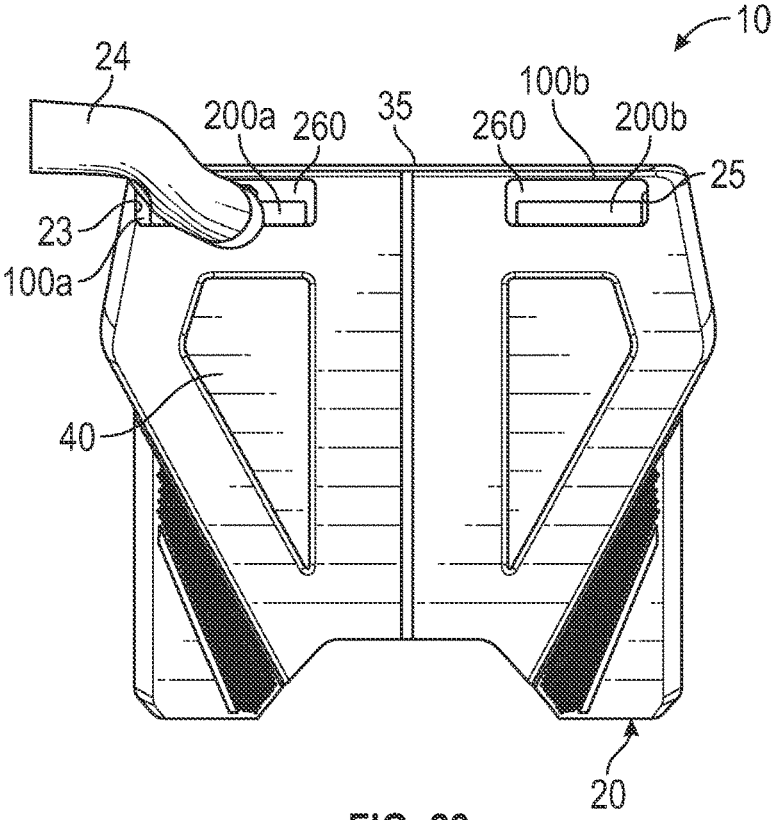
FIG. 28 is a top plan view of a fifteenth embodiment of the present invention.
Figure 29:
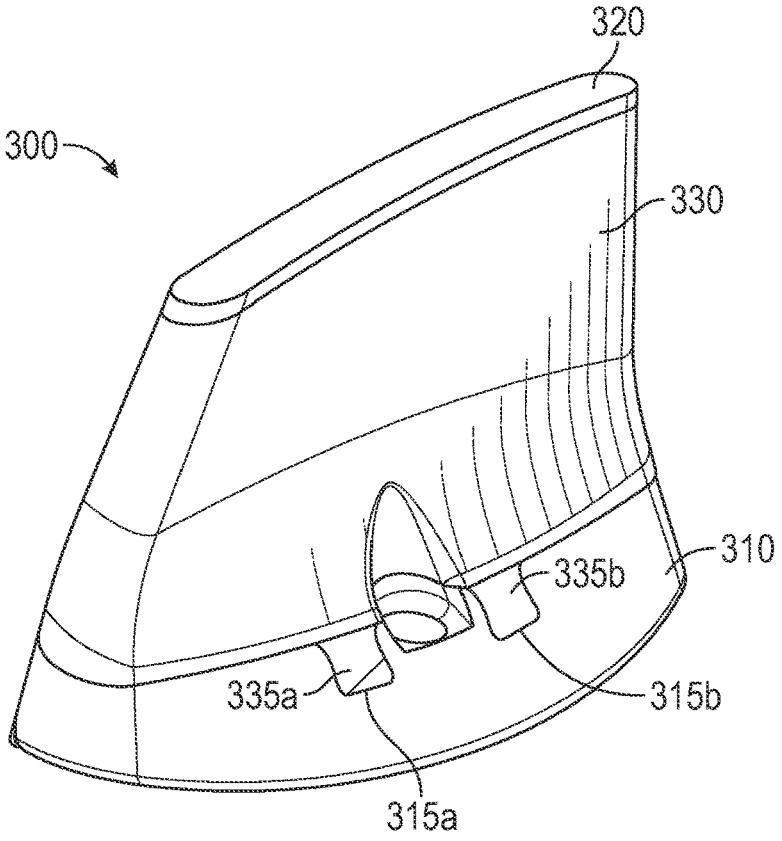
FIG. 29 is a rear perspective view of another embodiment of a weight sized to fit within a hollow stiffening structure of the present invention.
Figure 30:
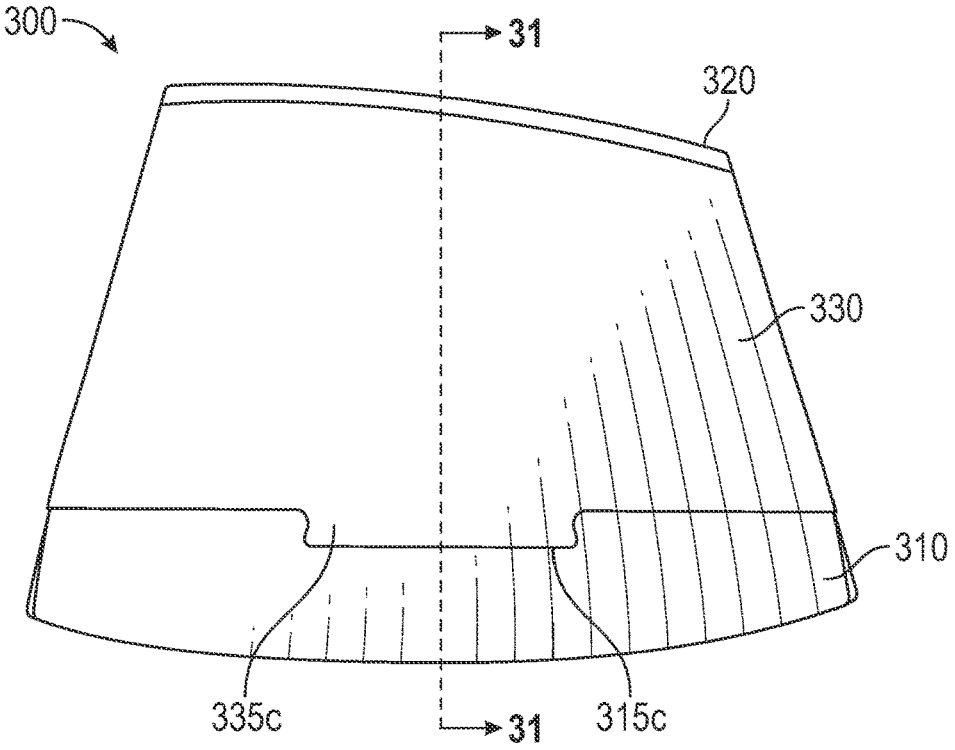
FIG. 30 is a front plan view of the embodiment shown in FIG. 29.
Figure 31:
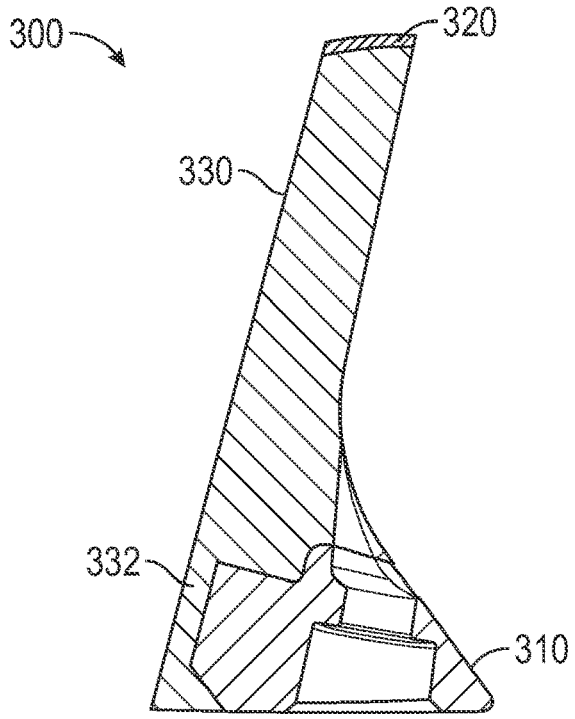
FIG. 31 is a cross-sectional view of the embodiment shown in FIG. 30 taken along lines 31-31.
Figure 32:
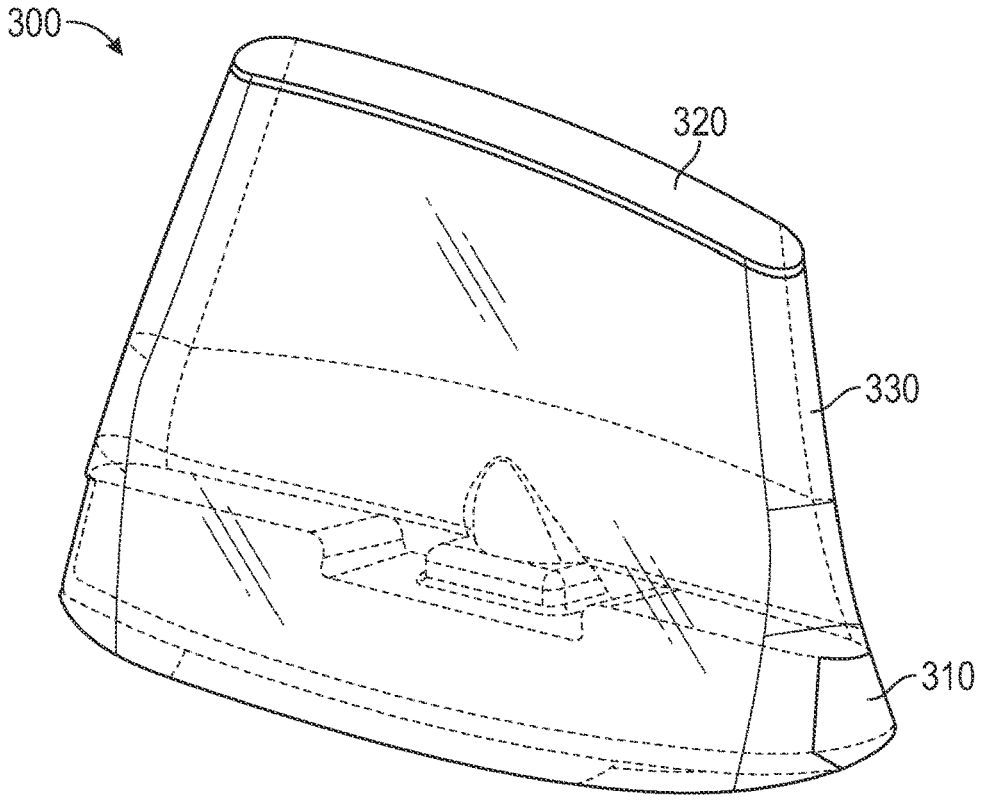
FIG. 32 is a partially transparent front plan view of the embodiment shown in FIG. 29.
Figure 33:
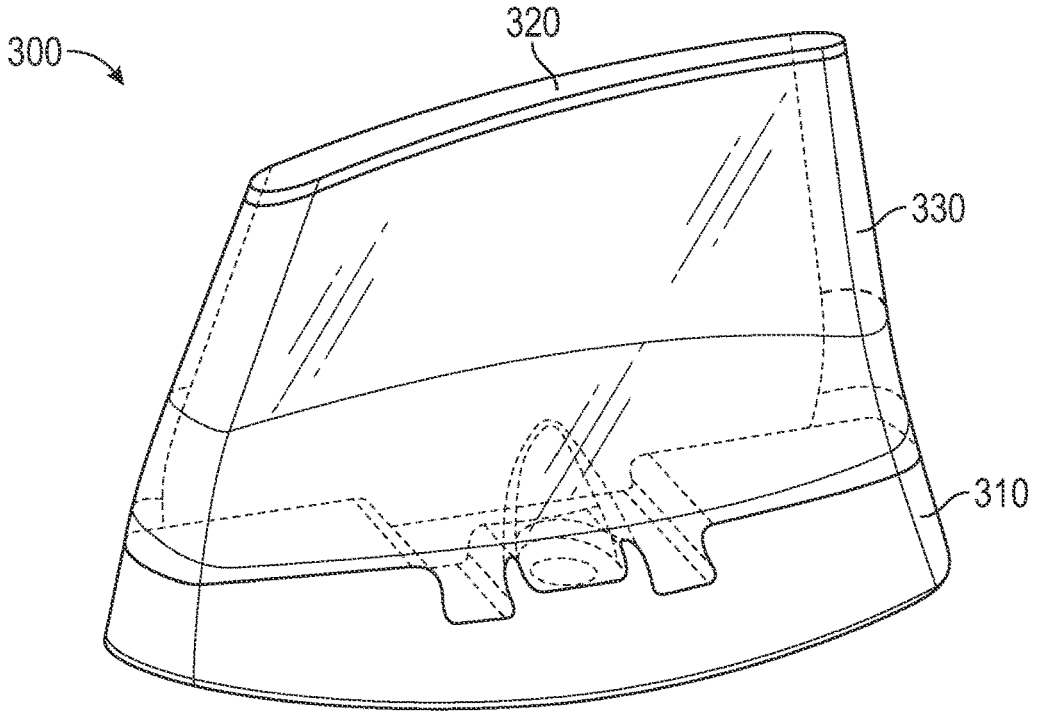
FIG. 33 is a rear perspective view of the embodiment shown in FIG. 32.
Figure 34:
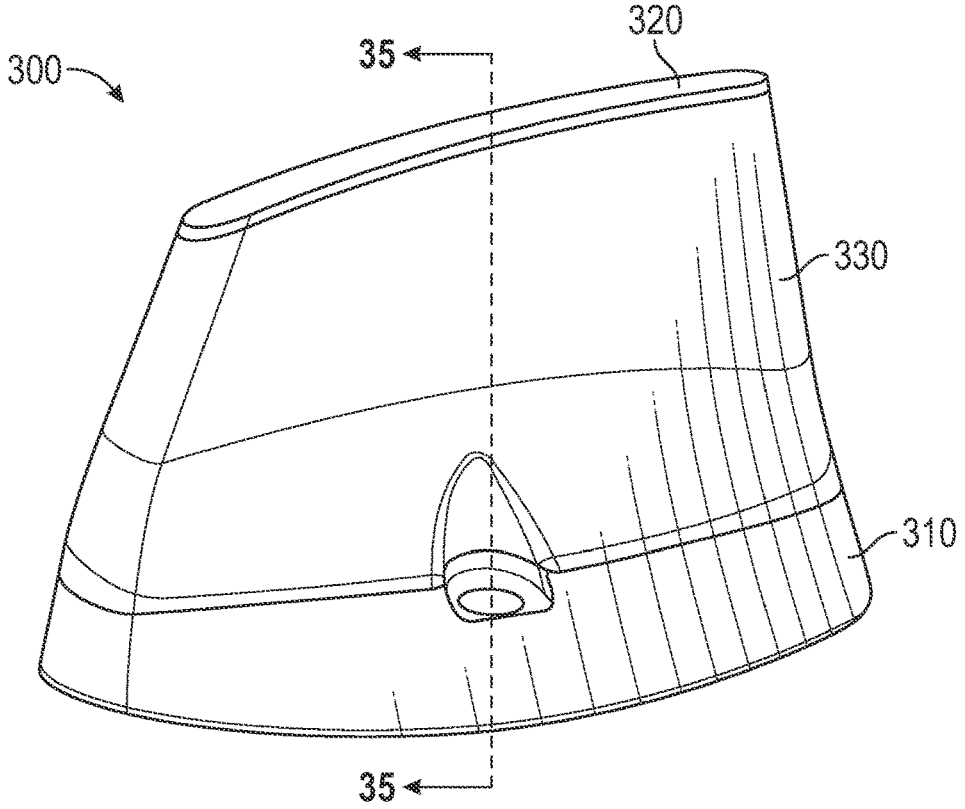
FIG. 34 is a rear perspective view of another embodiment of a weight sized to fit within a hollow stiffening structure of the present invention.
Figure 35:
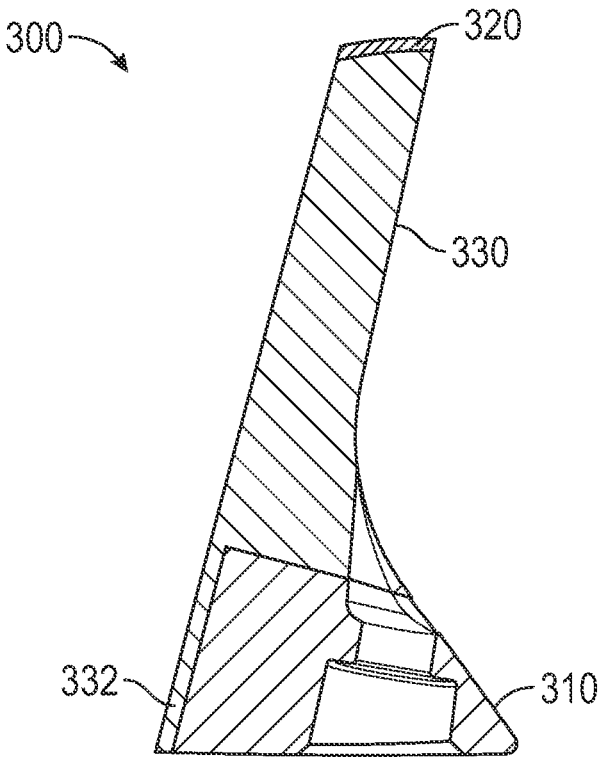
FIG. 35 is a cross-sectional view of the embodiment shown in FIG. 34 taken along lines 35-35.
Figure 36:
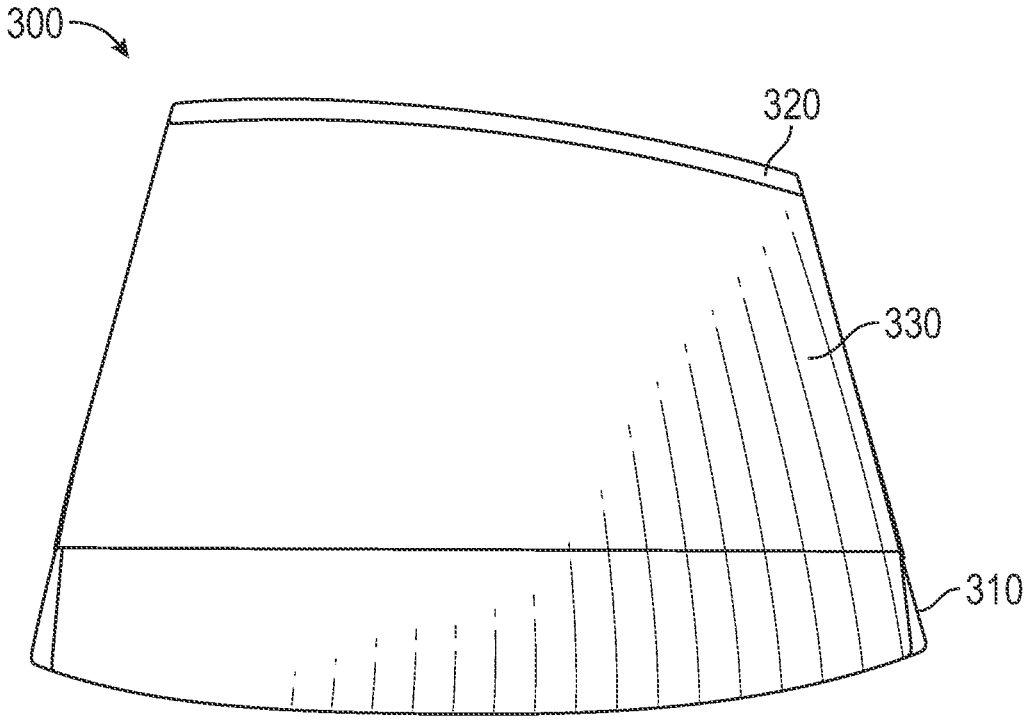
FIG. 36 is a front plan view of the embodiment shown in FIG. 34.
Figure 37:
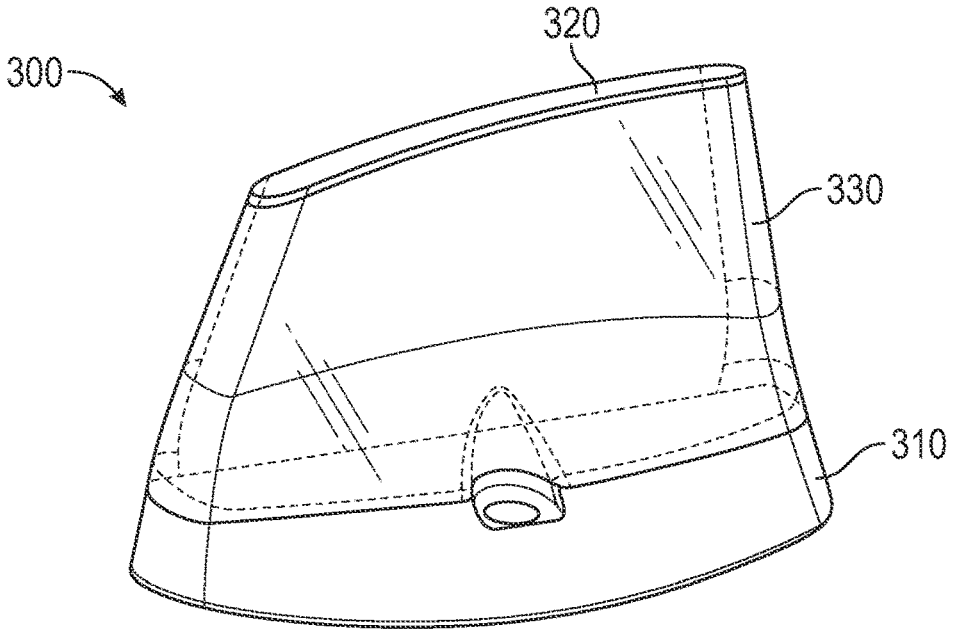
FIG. 37 is a partially transparent view of the embodiment shown in FIG. 34.
Figure 38:
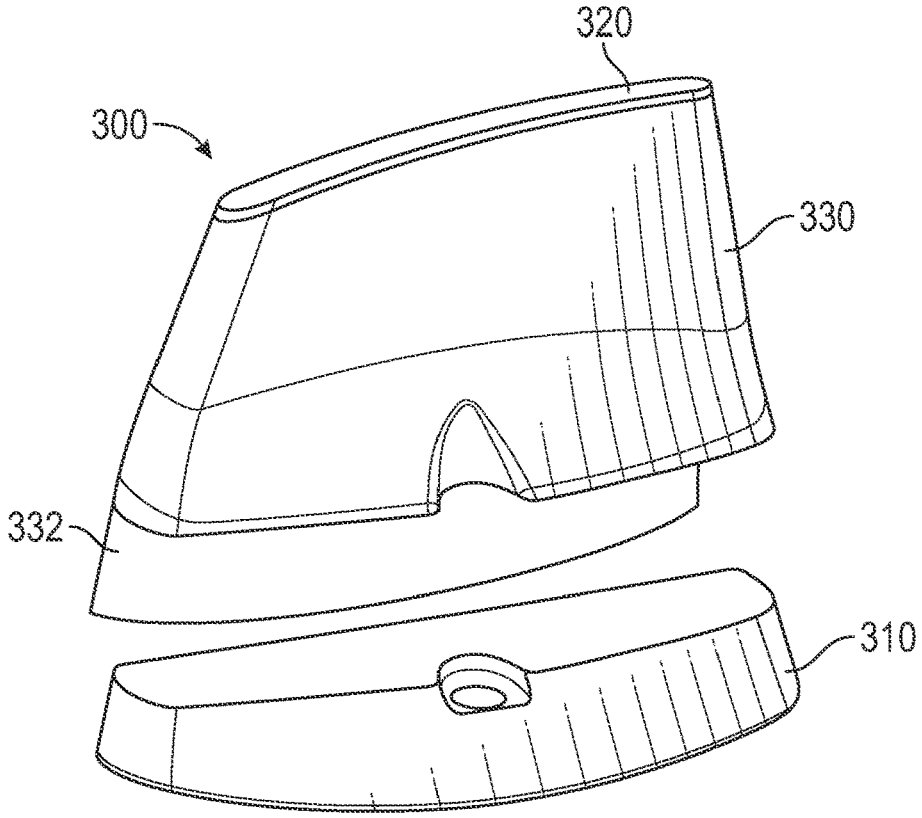
FIG. 38 is an exploded view of the embodiment shown in FIG. 34.
Figure 39:
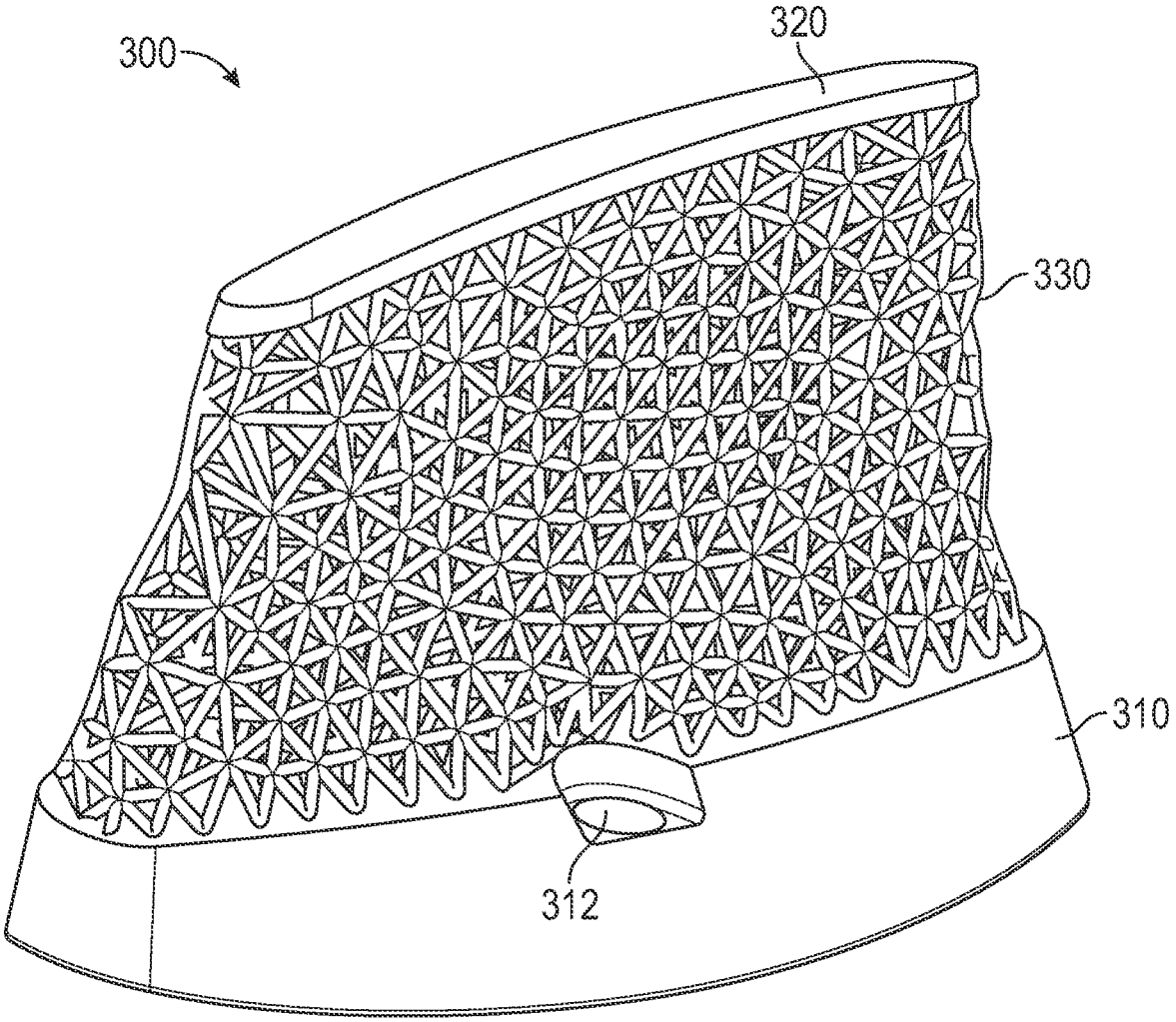
FIG. 39 is a rear perspective view of another embodiment of a weight sized to fit within a hollow stiffening structure of the present invention.
Figure 40:
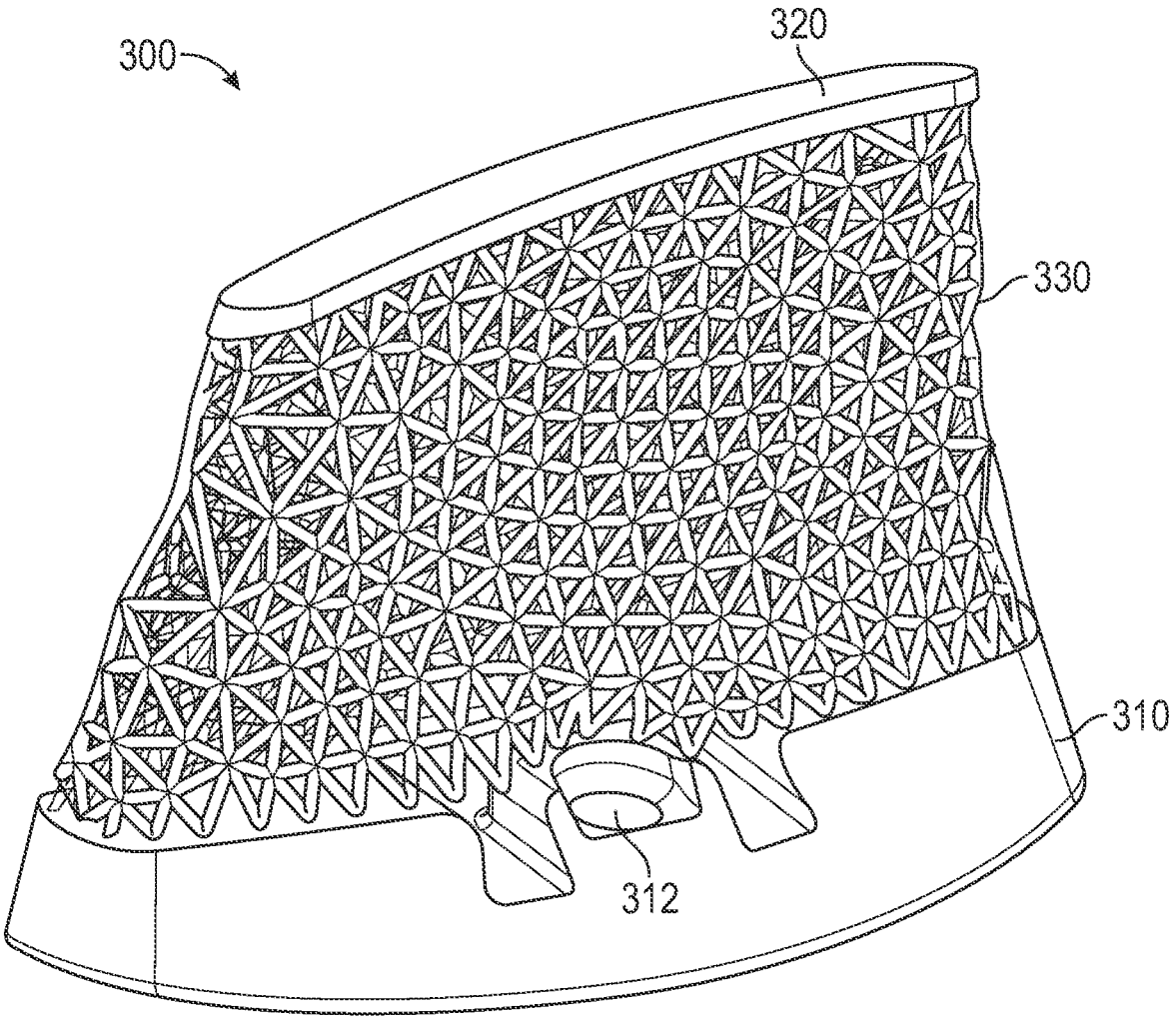
FIG. 40 is a partially transparent, rear perspective view of another embodiment of a weight sized to fit within the hollow stiffening structure of the present invention.
Figure 41:
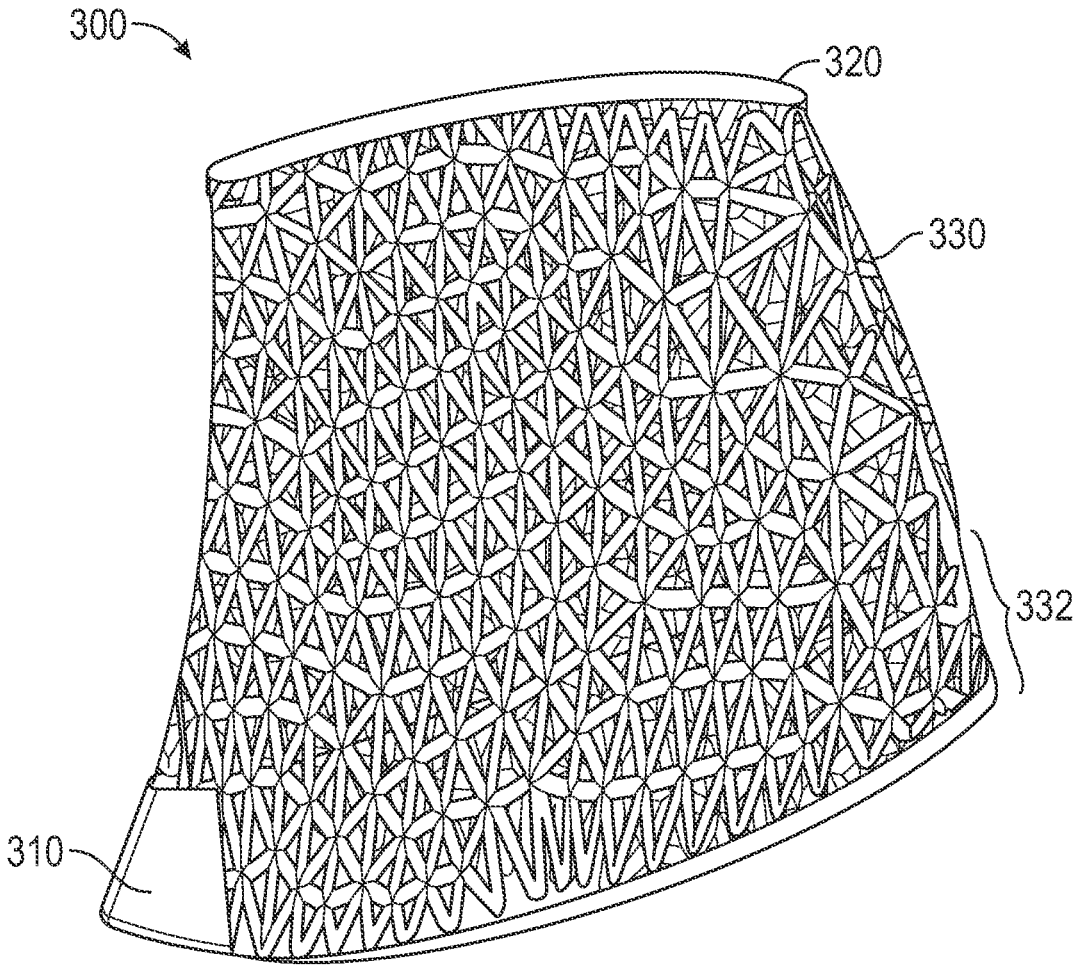
FIG. 41 is a front perspective view of the embodiment shown in FIG. 40.
Figure 42:
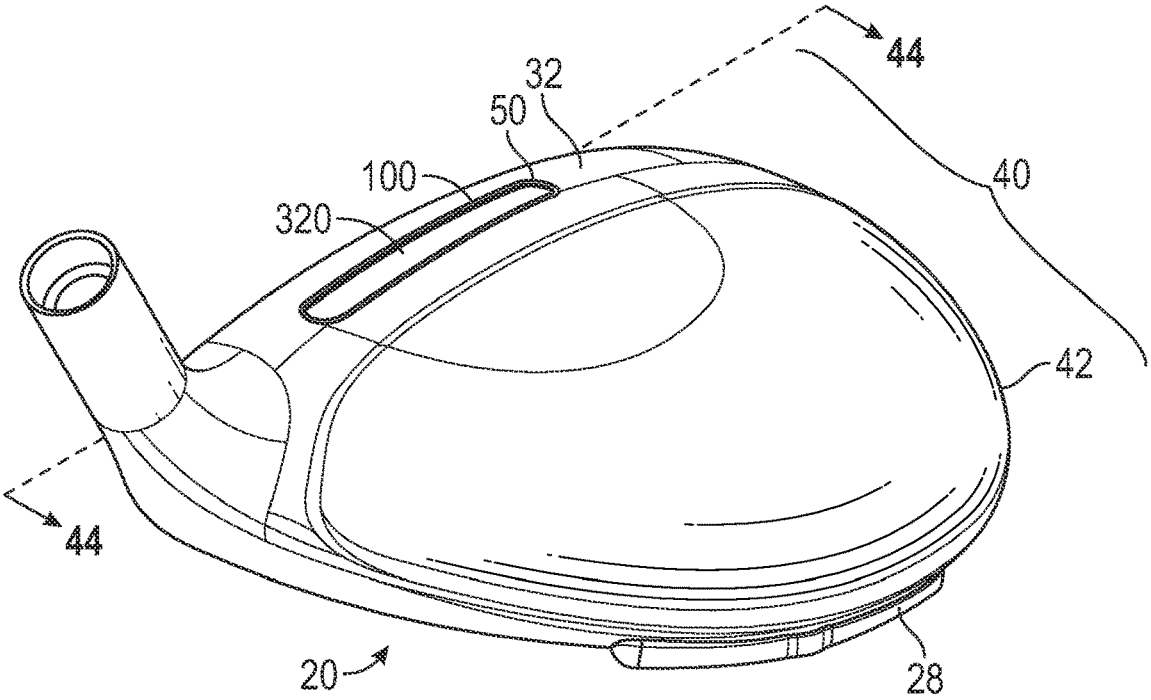
FIG. 42 is a top perspective view of a golf club head engaged with the stiffening structure shown in FIG. 40.
Figure 43:
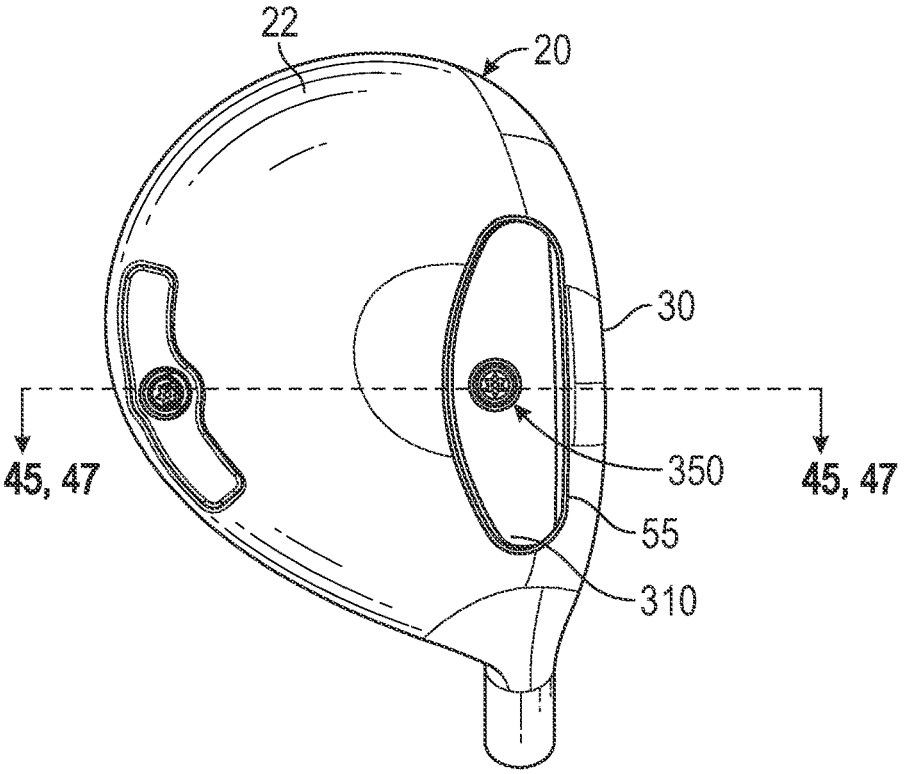
FIG. 43 is a sole plan view of the embodiment shown in FIG. 42.
Figure 44:
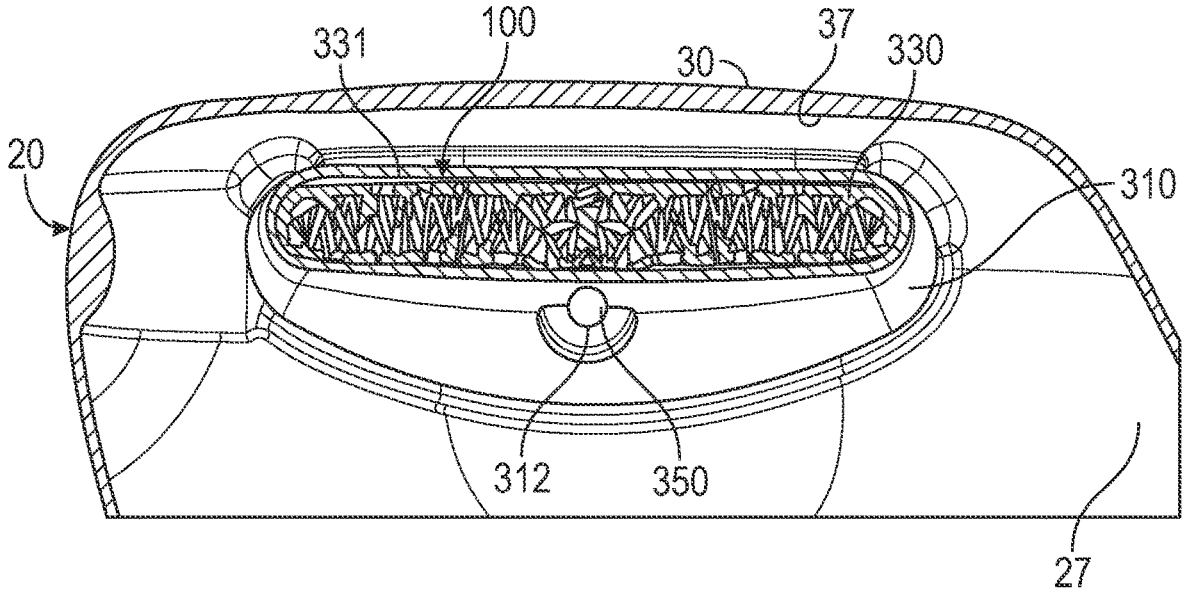
FIG. 44 is a cross-sectional view of the embodiment shown in FIG. 42 taken along lines 44-44.
Figure 45:
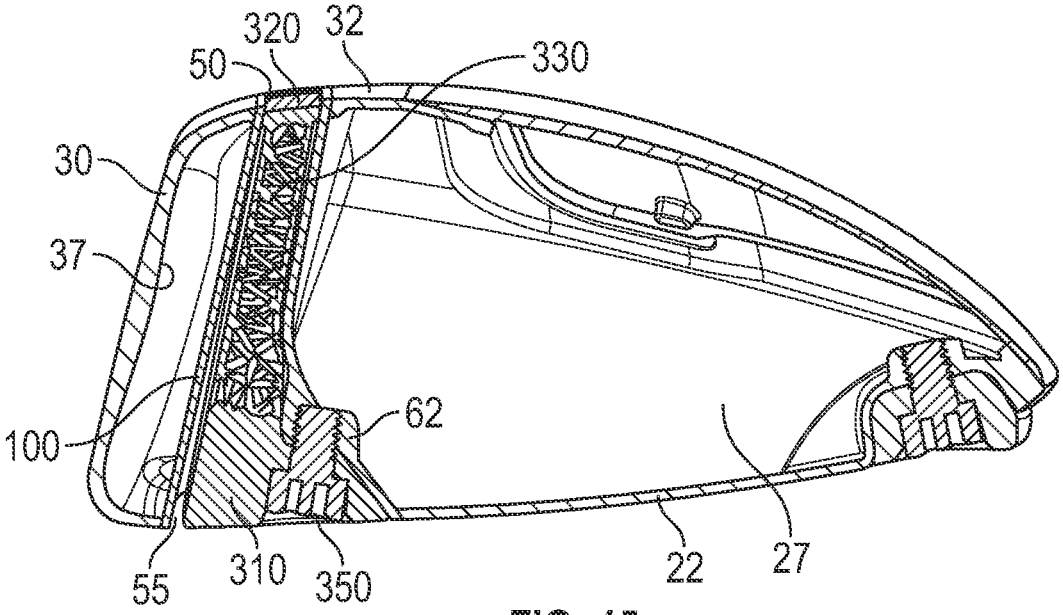
FIG. 45 is a cross-sectional view of the embodiment shown in FIG. 43 taken along lines 45-45.
Figure 46:
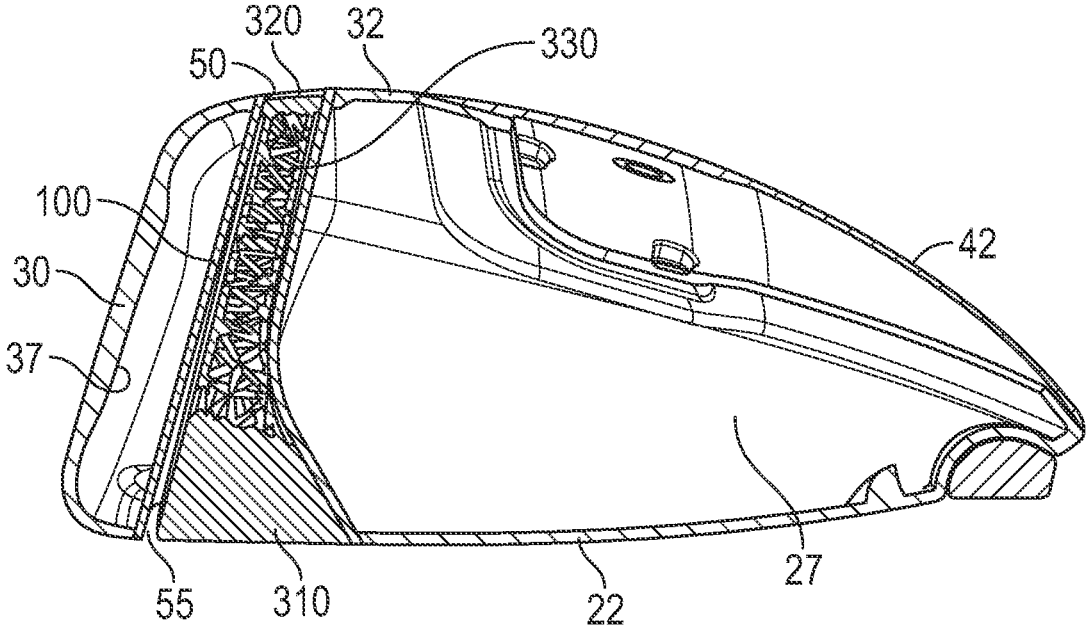
FIG. 46 is a cross-sectional view of an alternative embodiment of the golf club head of the present invention.
Figure 47:
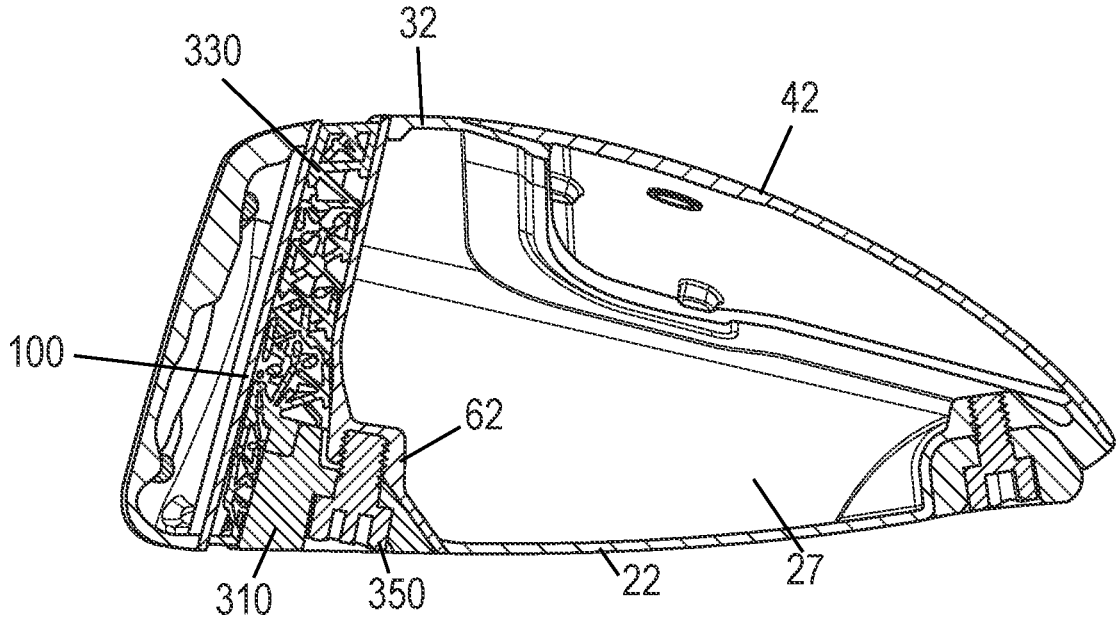
FIG. 47 is a cross-sectional view of the embodiment shown in FIG. 43 taken along lines 47-47.

The embodiment shown in FIGS. 27 and 28 further separates the weights 200*a*, 200*b* toward the heel 23 and toe 25 ends of the club head 10 respectively by placing each of them in separate hollow stiffening structures 100*a*, 100*b* disposed at the heel 23 and toe 25 ends of the body 20. Each hollow stiffening structure 100*a*, 100*b* is filled with the polymer fill 260 to secure the weights 200*a*, 200*b* within the structures 100*a*, 100*b*. The difference between the two embodiments shown in these Figures is the location of the hosel 24, which is centered on the crown 40 in the embodiment of FIG. 27 and on the heel 23 of the body in the embodiment of FIG. 28. Centering the hosel 24 reduces the manufacturing cost, which is increased by locating the hosel 24 above or proximate the heel 23 hosel stiffening structure 100*a*. The centered hosel 24 also allows the putter to be used as a freely swinging pendulum, removing the need for much muscle activation in the forearms to swing. In other words, a golfer can swing the putter with minimal effort to reduce human error during a putt.

Figure 48:
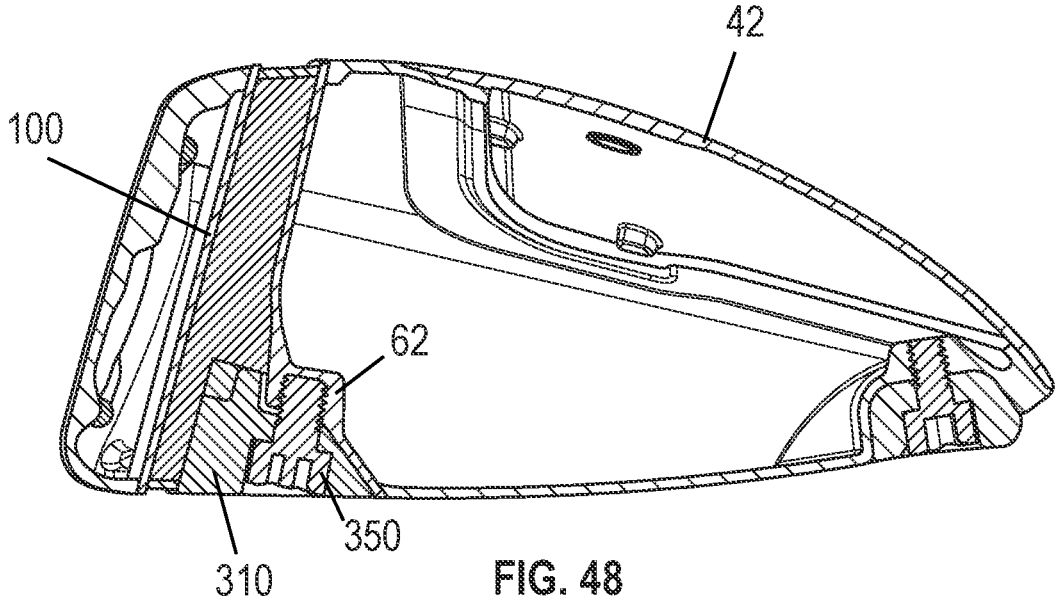
FIG. 48 is a cross-sectional view of an alternative embodiment of the golf club head of the present invention.

In other embodiments, shown in FIGS. 29-47, the weight 300 is a multi-material component composed of at least three portions: a flared, weighted base 310; a top rail 320; and a lattice midsection 330. This preferred embodiment differs from the other embodiments of the present invention in that the weight 300 extends along the entire vertical length of the hollow stiffening structure 100. Each of the weight portions 310, 320, 330 is made of a different material with different densities. In particular, the base 320 is preferably composed of a tungsten alloy, the top rail 320 is composed of a lightweight metal such as aluminum alloy or a composite, and preferably is made of the same material as that of the return section 32, crown section 40, crown insert 42, or topline 41 of whatever golf club head 10 it is engaged with, and the lattice midsection 330 is composed of one or a combination of materials selected from the group consisting of metals, polymers, and foams. The lattice midsection 330 preferably is 3D printed or manufactured using one or more of the methods disclosed in U.S. patent application Ser. No. 17/327,483, the disclosure of which is hereby incorporated by reference herein. In an alternative embodiment, the top rail 320 may be integrally formed (3D printed) with the lattice midsection 330 and thus made of the same material as the lattice midsection 330. In an alternative embodiment, shown in FIG. 48, the midsection may be a solid material that does not comprise a lattice structure.

Once each portion 310, 320, 330 of the weight 300 is manufactured, the base 310 and topline 320 can be glued or otherwise affixed to the lower and upper portions 332, 334 of the lattice midsection 330 so that they effectively act as bottom and top caps of the midsection 330. For example, as shown in FIGS. 29-33, the base 310 and midsection 330 have interlocking tongue and groove features 335, 315 that lock the two portions 310, 330 together. In the embodiment shown in FIGS. 34-41, the base 310 and midsection 330 are adhered directly to one another. In the preferred embodiment, shown in FIGS. 39-41, the midsection 330 has an overhang portion 332 that extends over the front of the base 310 and faces the rear surface 37 of the face section 30 within the hollow stiffening structure 100 as shown in FIGS.

31, 35, 38, 41, 47, and 48, thereby providing dampening functionality for the entire vertical length of the hollow stiffening structure 100.

As illustrated in FIGS. 42-48, when the weight 300 is fully engaged within the hollow stiffening structure 100 of a body 20 having features similar to the embodiment shown in FIG. 20, the top rail 320 fills the elongated upper opening 50 to prevent debris from entering the body 20 when the golf club head 10 is in use. The base portion 310 preferably has a threaded through opening 312 that is sized to align with a port 62 in the stiffening structure 100 (or the sole 22) and to receive a retention screw 350 that affixes the weight 300 within the stiffening structure 100 and to the body 20, as shown in FIGS. 43-45 and 47-48. In an alternative embodiment, shown in FIG. 46, the base 310 may be affixed to the body 20 or the stiffening structure 100 with adhesive or another means known to a person skilled in the art.

The base 310 functions by lowering the center of gravity of the club head 10, and the lattice midsection 330 improves the stiffness of the face section 30 while at the same time dampening the sound of the golf club head 10 when striking a ball. The lattice pattern in the midsection 330 can be adjusted by the manufacturer to customize the mass properties of the golf club head 10 when assembled with the head 10 to fit specific players or types of players. Such customization can be accomplished independently of the rest of the golf club head 10, which allows a manufacturer to fine tune a standardized golf club head 10 for different players by inserting different stiffening structures 300 with different lattice patterns within the midsection 330.

Figure 5:
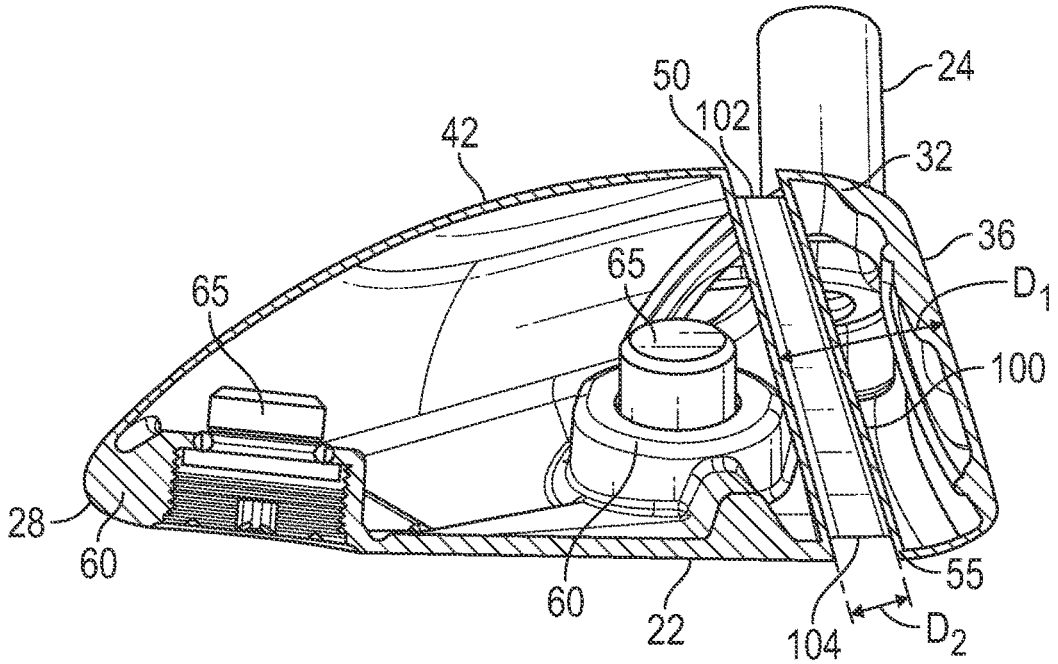
FIG. 5 is a cross-sectional view of the golf club head shown in FIG. 2 taken along lines 5-5.

As shown in FIGS. 5 and 14, in each of the embodiments disclosed herein, the entirety of the hollow stiffening structure 100 is located a depth $D_1$ of less than 1.5 inches from the rear surface 36 of the face section 30, measured along a vertical plane extending along the vertical Z-axis and horizontal X-axis extending through the face center 34 perpendicular to the face section 30. No portion of the hollow stiffening structure 100 should be disposed outside of this 1.5-inch range. Locating the stiffening structure 100 in this way has the greatest stress-reducing effect on the golf club head 10, and allows the thickness of the striking face section 30 to be reduced, thus freeing up discretionary mass. If any portion of the hollow stiffening structure 100 is placed more than 1.5 inch away from the rear surface 36 of the face section 30, it will not have a noticeable effect on the stress placed on the face section 30 when the golf club head 10 is in use, and will use up mass without creating a significant performance benefit. Furthermore, the hollow stiffening structure 100 in any of these embodiments has a y-axis depth $D_2$ that ranges from 0.030 to 1 inch.

The golf club head of the present invention has improved performance characteristics when a golf ball is hit on the low center of the face compared with prior art clubs that lack the features disclosed herein. The structure allows for this improvement without significantly reducing performance of the golf club for shots hit in the center of the face, and without increasing CT of the golf club head. The structure has a secondary benefit of increasing some performance metrics for high center shots as well. While the preferred embodiment of the structure is shown herein in connection with a fairway wood-type golf club head with a mass of 135 grams to 250 grams, and preferably from 140 grams to 165 grams, it may also be incorporated into driver, hybrid, iron, and putter type golf club heads.

The hollow stiffening structure 100 of the present invention works in three ways. First, the hollow stiffening structure 100 reduces the stiffness of the club body 20 in the horizontal, front-to-back x-axis direction close to the face section 30 in areas on the sole 22 and crown 40 of the golf club. This allows for higher ball speed and improved metrics for shots hit on the low center and high center of the face insert 36. Second, the hollow stiffening structure 100 increases stiffness of the club body in the z-axis (vertical) direction, which allows for increased ball speed for a majority of impact locations on the face insert 36, and simultaneously reduces CT of the golf club 10. This vertical stiffening effect also constrains the edges of the horizontally reduced stiffness areas, preventing the body from wrapping around itself. Third, the hollow stiffening structure 100 reduces stress in the center and low center areas of the face insert 36, allowing for the center and low center of the face insert 36 to be made thinner without exceeding stress constraints, which allows for additional increases in shot performance.

The hollow stiffening structure 100 may be composed of any strong material, but preferably is composed of the same material as that of the body 20 of the golf club head 10, which may be steel or titanium alloy. In other embodiments, the structure 100 may be made of a different material from the body 20, such as non-metal materials such as plastic or carbon composite. The structure 100, weights 65, 200, 300, washers 210, and/or retention screws 220 may be 3D printed and/or have lattice structures. In any event, it is critical that the stiffening structure 100 have an overall mass of less than 10 grams, and more preferably less than 8 grams, to conserve discretionary mass and avoid undesirable changes to the mass properties (such as center of gravity location) of the golf club head 10.

In each of the embodiments disclosed herein, the golf club head 10 preferably has a Characteristic Time (CT) of the face close to, but not exceeding, the 257 microsecond ("μS") limit set by the USGA. In each of the embodiments disclosed herein, the face insert 36 preferably has a varying thickness such as that described in U.S. Pat. No. 7,448,960, for a Golf Club Head With Variable Face Thickness, which pertinent parts are hereby incorporated by reference. Other alternative embodiments of the thickness of the face insert 36 are disclosed in U.S. Pat. No. 6,398,666, for a Golf Club Striking Plate With Variable Thickness, U.S. Pat. No. 6,471,603, for a Contoured Golf Club Face and U.S. Pat. No. 6,368,234, for a Golf Club Striking Plate Having Elliptical Regions Of Thickness, all of which are owned by Callaway Golf Company and which pertinent parts are hereby incorporated by reference. Alternatively, the face insert 36 may have a uniform thickness.

In each of the embodiments disclosed herein, the body 20 is preferably cast from molten metal in a method such as the well-known lost-wax casting method. The metal for casting is preferably titanium or a titanium alloy such as 6-4 titanium alloy, alpha-beta titanium alloy or beta titanium alloy for forging, and 6-4 titanium for casting. Alternatively, the body 20 is composed of 17-4 steel alloy. Additional methods for manufacturing the body 20 include forming the body 20 from a flat sheet of metal, super-plastic forming the body from a flat sheet of metal, machining the body 20 from a solid block of metal, electrochemical milling the body 20 from a forged pre-form, casting the body using centrifugal casting, casting the body 20 using levitation casting, and like manufacturing methods.

In other embodiments, the golf club head 10 may have a multi-material composition such as any of those disclosed in U.S. Pat. Nos. 6,244,976, 6,332,847, 6,386,990, 6,406,378, 6,440,008, 6,471,604, 6,491,592, 6,527,650, 6,565,452, 6,575,845, 6,478,692, 6,582,323, 6,508,978, 6,592,466, 6,602,149, 6,607,452, 6,663,504, 6,669,578, 6,739,982, 6,758,763, 6,860,824, 6,994,637, 7,025,692, 7,070,517, 7,112,148, 7,118,493, 7,121,957, 7,125,344, 7,128,661, 7,163,470, 7,226,366, 7,252,600, 7,258,631, 7,314,418, 7,320,646, 7,387,577, 7,396,296, 7,402,112, 7,407,448, 7,413,520, 7,431,667, 7,438,647, 7,455,598, 7,476,161, 7,491,134, 7,497,787, 7,549,935, 7,578,751, 7,717,807, 7,749,096, and 7,749,097, the disclosure of each of which is hereby incorporated in its entirety herein.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim:

1. A golf club head comprising:

a body comprising a face section, a sole section extending from a lower edge of the face section and comprising a first elongated lower opening, a crown section extending from an upper edge of the face section and comprising a first elongated upper opening, a hosel, a heel end, a toe end, a hollow interior, and an aft end;

a hollow stiffening structure extending from the sole section to the crown section within the hollow interior, the hollow stiffening structure comprising at least one interior wall that is suspended within the hollow interior of the body; and a weight comprising a base comprising a first material, a top rail comprising a second material, and a lattice midsection comprising a third material, wherein an upper end of the hollow stiffening structure is disposed within the first elongated upper opening and comprises a second elongated upper opening in communication with an exterior of the golf club head, wherein a lower end of the hollow stiffening structure is disposed within the first elongated lower opening and comprises a second elongated lower opening in communication with the exterior of the golf club head, wherein the weight is disposed within the hollow stiffening structure so that the top rail is disposed within and substantially closes the second elongated upper opening, and the base is disposed within and substantially closes the second elongated lower opening, wherein the hollow stiffening structure does not contact any portion of the face section, and wherein the hollow stiffening structure is entirely disposed within 1.5 inches of a rear surface of the face insert measured along a vertical, front to back plane extending through a geometric center of the face section.

2. The golf club head of claim 1, further comprising a retention screw with a head portion and a threaded extension portion, wherein one of the sole and the hollow stiffening structure comprises a port disposed proximate the first elongated lower opening, wherein the base comprises a through-hole sized to receive the threaded extension portion, and wherein fully engaging the retention screw within the port causes the threaded extension portion to extend through the through-hole and the head portion to press against a lower end of the base and secure the weight within the hollow stiffening structure.

3. The golf club head of claim 1, wherein the hollow stiffening structure has a depth of 0.030 to 1 inch.

4. The golf club head of claim 1, wherein the top rail is integrally formed with the lattice midsection, and wherein the second material is the same as the third material.

5. The golf club head of claim 1, wherein the first material differs from the third material.

6. The golf club head of claim 1, wherein the second material differs from the first material and the third material, and wherein the crown section is composed of the second material.

7. The golf club head of claim 1, wherein the first material has a density of no less than 8 g/cc, wherein the second material has a density of no more than 8 g/cc, and wherein the third material has a density of no more than 5 g/cc.

8. The golf club head of claim 7, wherein the first material is a tungsten alloy, wherein the second material is selected from the group consisting of titanium alloy, steel, and aluminum alloy, and wherein the third material comprises a polymer.

9. The golf club head of claim 1, wherein the weight has a mass of 50 to 150 grams.

10. The golf club head of claim 9, wherein the base has a mass of 50 to 120 grams.

11. The golf club head of claim 10, wherein the lattice midsection has a mass of no more than 20 grams.

12. The golf club head of claim 1, wherein the body is composed of a metal alloy.

13. The golf club head of claim 12, wherein the hollow stiffening structure is composed of a metal alloy.

14. The golf club head of claim 12, wherein the hollow stiffening structure is composed of a non-metal material selected from the group consisting of plastic and carbon composite.

15. The golf club head of claim 14, wherein the hollow stiffening structure has a mass of less than 10 grams.

16. The golf club head of claim 1, wherein the top rail is affixed to the lattice midsection with an adhesive material.

17. The golf club head of claim 1, wherein the base is affixed to the lattice midsection with an adhesive material.

18. The golf club head of claim 17, wherein lattice midsection has an overhang portion that extends over a front portion of the base and faces a rear surface of the face section within the hollow stiffening member.

19. The golf club head of claim 1, wherein the base is affixed to the lattice midsection with a tongue and groove joint.

20. The golf club head of claim 1, wherein the golf club head is selected from the group consisting of a driver head, a fairway wood head, and a hybrid head.

* * * * *